US005808408A

United States Patent [19]

Nakamoto

[11] Patent Number: 5,808,408

[45] Date of Patent: Sep. 15, 1998

[54] PLASMA DISPLAY WITH PROJECTING DISCHARGE ELECTRODES

[75] Inventor: Masayuki Nakamoto, Chigasaki, Japan

[73] Assignee: Kabushiki Kaisha Toshiba, Kawasaki, Japan

[21] Appl. No.: 806,652

[22] Filed: Feb. 26, 1997

[30] Foreign Application Priority Data

| | | | |
|---|---|---|---|
| Feb. 26, 1996 | [JP] | Japan | 8-038113 |
| Mar. 11, 1996 | [JP] | Japan | 8-053243 |
| Feb. 10, 1997 | [JP] | Japan | 9-036362 |

[51] Int. Cl.[6] ..... H01J 17/49

[52] U.S. Cl. ..... 313/484; 313/491; 313/495; 313/351; 313/309

[58] Field of Search ..... 313/309, 336, 313/351, 584, 491, 495, 496, 497, 585, 586, 484

[56] References Cited

U.S. PATENT DOCUMENTS

| | | | |
|---|---|---|---|
| 3,743,879 | 7/1973 | Kupsky | 313/584 |
| 4,908,539 | 3/1990 | Meyer | 313/309 |
| 5,235,244 | 8/1993 | Spindt | 313/495 |
| 5,351,144 | 9/1994 | Taramachi | 313/484 |
| 5,483,118 | 1/1996 | Nakamoto et al. | 313/309 |
| 5,499,938 | 3/1996 | Nakamoto et al. | 445/50 |
| 5,561,340 | 10/1996 | Jin et al. | 313/309 |
| 5,663,611 | 9/1997 | Seats et al. | 313/584 |

OTHER PUBLICATIONS

Nikkei Electronics, Nov. 8, 1993, No.594, pp. 215–225 *Plasma Display Panels.*

Nikkei Electronics, Jul. 17, 1995, No.640, pp. 13–14 *Plasma Display Panels.*

*Primary Examiner*—Sandra L. O'Shea
*Assistant Examiner*—Michael Day
*Attorney, Agent, or Firm*—Oblon, Spivak, McClelland, Neustadt, P.C.

[57] ABSTRACT

A plasma display has a plurality of discharge cells arranged in a matrix. The discharge cells are formed of an air-tight space sealed by a support substrate, a cathode electrode, and a glass substrate, and storing a discharge gas, e.g., He—Ne, Ne—Xe, He—Xe, or the like. The distance among the cells, i.e., the width of each partition wall formed of the substrate is set to about 0.1 $\mu$m to 300 $\mu$m. An emitter for emitting electrons, and a counter electrode are disposed in the cell. The counter electrode is disposed on the glass substrate to oppose the emitter. The distal end portion of the emitter is sharp to have a radius of curvature of about 1 $\mu$m to 100 $\mu$m at its distal end.

18 Claims, 11 Drawing Sheets

PLASMA DISPLAY WITH PROJECTING DISCHARGE ELECTRODES

BACKGROUND OF THE INVENTION

The present invention relates to a plasma display and a plasma liquid crystal display.

Plasma displays have been actively developed in recent years in which visible light emitted from a plasma generated by rare gas discharge or ultraviolet rays emitted from a plasma are radiated on phosphors to utilize light emitted upon excitation of the phosphors. A plasma display is advantageous in a wide visual field angle, good readability with spontaneous emission, a high response speed, and a large size.

A conventional plasma display has parallel-plate cathode and anode opposing each other, and an He—Ne, Ne—Xe, or He—Xe (1 to several %) gas mixture is sealed in cells as a discharge gas. An electric field is applied across the two electrodes to generate a plasma generally in accordance with glow discharge, thereby emitting visible light, or generate a plasma by an He—Xe (1 to several %) gas mixture to emit ultraviolet rays having the Xe wavelength of 147 nm, thereby exciting phosphors coated on the inner surfaces of discharge cells to emit light. Visible light or phosphor-emitted light emitted in this manner is diffused and radiated outside the screen. Therefore, a spontaneous emission flat display having a wide visual field angle and a high response speed when compared to that of a liquid crystal display can be obtained.

However, the conventional plasma display and a manufacturing method thereof pose the following serious problems.

First, since the conventional plasma display described above uses the parallel-plate electrodes and utilizes Ni (work function: 5.15 eV), Al (work function: 4.28 eV) or Mo (work function: 4.6 eV) having a large work function as the electrode material, a voltage required for causing discharge is as high as 150 V to 400 V, and normally 250 V to 400 V. For this reason, the drive circuit becomes complicated and expensive, and requires a large power consumption. Since a glow discharge plasma is normally used, and the ultraviolet conversion efficiency of the input power is low, heat may be generated due to the large power consumption, impeding the development of a low-profile device.

Since the parallel-plate electrodes are used for generating the plasma, the plasma spreads over the entire surfaces of the discharge cells or parallel-plate electrodes. Further, since the discharge cells are manufactured in accordance with screen printing, the pixel size is as large as 650 $\mu$m to 1,000 $\mu$m. Furthermore, where the distance between the parallel-plate electrodes is decreased to provide a high-resolution display, the drive voltage is increased in accordance with the Paschen's law. In this case, if the drive voltage is not to increase, the sealed discharge gas pressure must be increased greatly, thereby putting difficulties in sealing the discharge gas.

Since high-resolution pixels cannot be fabricated, a compact, high-resolution spontaneous emission flat display which has been strongly demanded in recent years as the viewfinder of a video camera or a mobile moving picture image display cannot be manufactured.

Along with the advance of an information-oriented society, liquid crystal displays (LCDs) having an advantage of low power consumption have been actively developed and recently put into practical use. In particular, active matrix-type liquid crystal displays (AMLCDs) in which an active element (switching element), e.g., a thin film transistor (TFT), is added for each pixel in order to improve the display quality are becoming most popular. In the LCDs using the TFTs, however, as the TFTs are difficult to manufacture, the yield is decreased to increase the product cost, and a large-size screen is difficult to form.

In order to solve these problems, a plasma addressing LCD is proposed in which plasma discharge is used to constitute a switching element in place of the TFT (Nikkei Electronics, Jul. 17, 1995, p. 13). FIG. 17 shows the schematic sectional structure of this LCD.

Each plasma discharge cell 181 in the structure shown in FIG. 17 is manufactured by inexpensive thick-film printing. First, an Ni paste is printed on a glass substrate 182 to form discharge electrodes 183*a* and 138*b* comprising flat films. A glass paste is printed on the glass substrate 182 to form partition walls 184 dividing the plasma discharge cells 181. A glass substrate 185 having a thickness of 50 $\mu$m is placed on the partition walls 184 as a dielectric insulating film, and a discharge gas is filled in each plasma discharge cell 181.

A spacer is formed on the glass substrate 185 by spraying and a glass substrate 186 on which a stripe-like transparent electrode 187 and a glass filter 188 are disposed is placed on the spacer. A liquid crystal is injected into the gap between the glass substrates 185 and 186 to form a liquid crystal layer 189.

Since the liquid crystal display having the structure described above and using the plasma discharge cells as the active elements can be manufactured by utilizing thick-film printing, the yield is increased and a large-size screen can be formed.

However, the conventional plasma liquid crystal display and the manufacturing method thereof pose the following serious problems.

First, since the conventional plasma display described above uses the parallel-plate electrodes and utilizes Ni having a large work function (5.15 eV) as the electrode material, a voltage required for causing discharge is as high as 300 V. For this reason, the drive circuit becomes complicated and expensive, and requires a power consumption of as large as 100 W. Since a glow discharge plasma is used, and the ultraviolet conversion efficiency of the input power is low, heat may be generated due to the large power consumption, impeding the development of a low-profile device. Even if the electrode material is changed to Al (4.28 eV) or Mo (4.6 eV) that has been tried in plasma displays, the voltage required for causing discharge is as very high as 150 V to 400 V, and normally 250 V to 400 V.

Since the parallel-plate electrodes are used for generating the plasma, the plasma spreads over the entire surfaces of the discharge cells or parallel-plate electrodes. Further, since the discharge cells are manufactured in accordance with screen printing, the pixel size is as large as 650 $\mu$m to 1,000 $\mu$m. Furthermore, where the distance between the parallel-plate electrodes is decreased to provide a high-resolution display, the drive voltage is increased in accordance with the Paschen's law. In this case, if the drive voltage is not to increase, the sealed discharge gas pressure must be increased greatly, thereby putting difficulties in sealing the discharge gas.

Since high-resolution pixels cannot be fabricated, when fabricating a display used for a high-definition television and having 1,125 scanning lines, the screen size must be increased to 40 inches or more. Regarding this point, if TFT color liquid crystals are used, a 10-inch display having 800×600 pixels can be manufactured. Furthermore, a compact, high-resolution spontaneous emission flat display which has been strongly demanded in recent years as the viewfinder of a video camera or a mobile moving picture image display cannot be manufactured. Accordingly, the conventional display described above is used only in restricted applications.

BRIEF SUMMARY OF THE INVENTION

It is an object of the present invention to provide a plasma display in which the drive voltage is low, the phosphor brightness is high, the drive circuit is simple, the problem of heat dissipation is solved, and pixels can be micropatterned.

It is another object of the present invention to provide a plasma liquid crystal display, and in particular a microplasma liquid crystal display, in which the drive voltage is low, the drive circuit is simple, the problem of heat dissipation is solved, and pixels can be micropatterned.

According to a first aspect of the present invention, there is provided a plasma display comprising:

an air-tight sealed space formed between a first substrate and a transparent second substrate;

a discharge gas stored in the sealed space;

a plurality of discharge cells arranged in the sealed space to correspond to a plurality of pixels arranged in a matrix to form an image;

a projecting discharge electrode supported by the first substrate and having a sharp distal end portion disposed in each of the discharge cells; and a counter electrode disposed in the discharge cell to oppose the distal end portion of the discharge electrode.

According to a second aspect of the present invention, there is provided a plasma liquid crystal display comprising:

an air-tight sealed space formed between a first substrate and a dielectric second substrate;

a discharge gas stored in the sealed space;

a plurality of discharge cells arranged in the sealed space to correspond to a plurality of pixels arranged in a matrix to form an image;

a projecting discharge electrode supported by the first substrate and having a sharp distal end portion disposed in each of the discharge cells;

a counter electrode disposed in the discharge cell to oppose the distal end portion of the discharge electrode;

a liquid crystal layer disposed on the second substrate and having a transmittance that changes in accordance with a change in applied voltage; and a transparent electrode opposing the discharge cells through the liquid crystal layer, wherein the discharge cells serve as switching elements that change, on the basis of conversion of the discharge gas into a plasma, a state of the liquid crystal layer so as to correspond to the respective pixels.

In the conventional plasma display, the parallel-plate electrodes are used as described above. Thus, where the distance between the electrodes is decreased to provide a high-resolution display, the drive voltage is increased in accordance with the Paschen's law. In this case, if the drive voltage is not to increase, the sealed discharge gas pressure must be increased greatly, thereby putting difficulties in sealing the discharge gas.

In contrast to this, the plasma display or plasma liquid crystal display according to the present invention is free from these problems, and the drive voltage can be decreased without increasing the sealed discharge gas pressure. The reason for this will be described.

FIG. 6 is a graph showing relationships between the radii of curvature of the distal end portion of a discharge electrode and the discharge voltages when the sealed discharge gas pressure is constant. A plurality of curves in FIG. 6 represent cases wherein the distances between the discharge electrode and the counter electrode are 200 $\mu$m, 180 $\mu$m, 150 $\mu$m, 130 $\mu$m, 100 $\mu$m, and 50 $\mu$m, respectively.

As shown in FIG. 6, if the distance between the electrodes is 200 $\mu$m, the discharge voltage is greatly decreased when the radius of curvature becomes about 140 $\mu$m or less, and in particular 100 $\mu$m or less. If the distance between the electrodes is 50 $\mu$m, the discharge voltage is greatly decreased similarly when the radius of curvature becomes about 40 $\mu$m or less. As can be apparent from these results, if a sharp discharge electrode is used, the Paschen's law does not apply, and the discharge voltage, i.e., the drive voltage, can be decreased without increasing the sealed discharge gas pressure.

It was found that, however, if the radius of curvature was less than 1 $\mu$m, while the discharge voltage was greatly decreased, the distal end portion of the discharge electrode deteriorated greatly.

Considering the above respects, in the present invention, the preferable range of the radius of curvature of the sharp discharge electrode is set within a range of 1 $\mu$m to 100 $\mu$m.

In the present invention, the term "discharge cell" means the unit of discharge area arranged in an air-tight space to correspond to a plurality of pixels arranged in a matrix to display an image. Accordingly, a discharge area corresponding to the pixels is expressed by the unit "discharge cell" not only when the discharge areas are divided by partition walls to correspond to the pixels but also when no partition walls are present in the discharge areas and the discharge areas are partly or entirely integral spatially. As in several embodiments to be described later, even when partition walls are formed between the discharge cells, the partition walls normally do not completely separate the respective discharge cells spatially to be independent of each other, but the discharge cells are formed to be spatially communicate with each other.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE INVENTION

Figure 1:
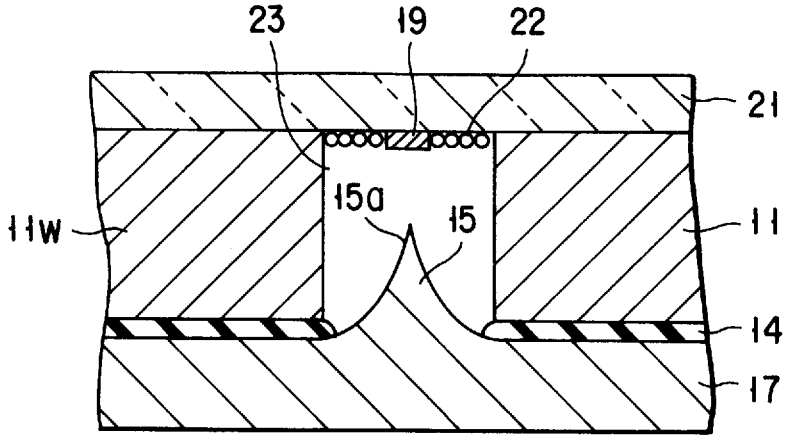
FIG. 1 is a sectional view illustrating a plasma display according to an embodiment of the present invention.

FIG. 1 is a sectional view illustrating a plasma display according to an embodiment of the present invention.

As shown in FIG. 1, the plasma display according to this embodiment has a plurality of discharge cells 23 arranged in a matrix. The discharge cells 23 are formed of an air-tight space sealed by a support substrate 11, a cathode electrode 17, and a transparent substrate 21, and storing a discharge gas, e.g., He—Ne, Ne—Xe, He—Xe, or the like. The distance among the discharge cells 23, i.e., the width of each partition wall 11*w* formed of the substrate 11 is set to about 0.1 $\mu$m to 300 $\mu$m, and preferably 100 $\mu$m or less. An emitter 15 for emitting electrons, and a counter electrode 19 are disposed in the discharge cell 23. The counter electrode 19 is placed on the glass substrate 21 to oppose the emitter 15. Although only one emitter 15 is shown in FIG. 1, a plurality of emitters may be disposed in each discharge cell 23. When phosphor emission is utilized, in the discharge cell 23, a phosphor layer 22 is further disposed on, e.g., the glass substrate 21.

A distal end portion 15*a* of the emitter 15 is sharp with the radius of curvature at its distal end of about 1 $\mu$m to 100 $\mu$m. As the emitter material, a normal electrode material, e.g., molybdenum, tungsten, or Si, can be used. As the emitter material, various types of materials having low work functions can also be used. An example of the material having a low work function includes diamond which has a negative electron affinity (an apparent negative work function) to emit electrons easily, can obtain a large current, is resistant against ion impact, is chemically stable, and is substantially free from the influence of gas adsorption. Ferroelectrics, e.g., PZT (lead zirconate titanate) or PLZT (lead lanthanum zirconate titanate), which can emit a large current upon polarization inversion, is resistant against ion impact in the same manner as diamond, is chemically stable, and is substantially free from the influence of gas adsorption, can also be used.

In the plasma display shown in FIG. 1, when compared to a conventional plasma display using parallel-plate electrodes and employing Ni (work function: 5.15 eV), Al (work function: 4.28 eV), or Mo (work function: 4.6 eV) having a large work function as the electrode material, the electric field is concentrated on the distal end portion 15*a* of the pointed emitter, i.e., the projecting electrode 15, so that electrons are emitted easily, thus generating a discharge plasma. Accordingly, the discharge voltage, i.e., the drive voltage, can be decreased from the conventional value ranging from 150 V to 400 V, and normally 250 V to 400 V, to 25 V to 135 V. As a result, the drive circuit becomes simple, and the power consumption can be largely decreased. Then, heat generation is decreased, which is effective as a heat dissipation countermeasure and for a low-profile structure.

Since a strong electric field can be applied to the projecting electrode with a low drive voltage, Townsend discharge providing a higher ultraviolet conversion efficiency than in the conventional plasma display utilizing glow discharge can be utilized. Then, the phosphor brightness is largely increased, contributing to a decrease in power consumption. When Townsend discharge as transient discharge is utilized, a high-speed response is enabled.

Since the projecting emitter, i.e., the emitter 15, is used, the distance between the electrodes can be decreased by controlling the magnitude of the discharge voltage and the gas pressure or decreasing the radius of curvature of the distal end portion 15*a* of the projecting electrode 15, unlike in the case using the parallel-plate electrodes, while maintaining the gas pressure to substantially a constant value without largely increasing it, unlike in the conventional case. Accordingly, a small microplasma having a discharge area with a diameter of about 1 $\mu$m to 200 $\mu$m can be generated. As a result, the discharge cells can be made small, thus contributing to a low-profile structure. Further, where the distance between the electrodes 15 and 19 is decreased, a plasma generated in a discharge cell does not spread to the other discharge cells. As a result, hardly any problems are caused in relation to cross talk of ultraviolet rays, so that the partition wall 11*w* can be omitted.

FIGS. 4A to 4F are sectional views illustrating a method of manufacturing the plasma display shown in FIG. 1 in the order of manufacturing steps. In the manufacturing method shown in FIGS. 4A to 4F, the cathode electrode and the emitter 15 are formed integrally, and as the emitter material, molybdenum, tungsten, Si, or diamond is used.

First, the first recessed portion having a sharp bottom portion is formed in one surface of a single-crystal substrate. To form such a recessed portion, a method utilizing anisotropic etching of an Si single-crystal substrate to be described below is available.

Figure 4A:
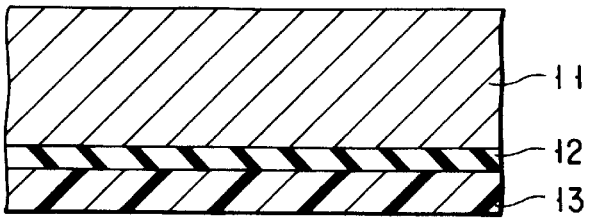
FIGS. 4A to 4F are sectional views illustrating a method of manufacturing the plasma display shown in FIG. 1 in the order of manufacturing steps.

More specifically, an $SiO_2$ thermal oxide layer 12 is formed to a thickness of 0.1 μm on the p-type Si single-crystal substrate 11 having a crystal face orientation of (100) by dry oxidization. Subsequently, a resist is applied to the thermal oxide layer 12 by spin coating to form a resist layer 13 (FIG. 4A).

Figure 4B:
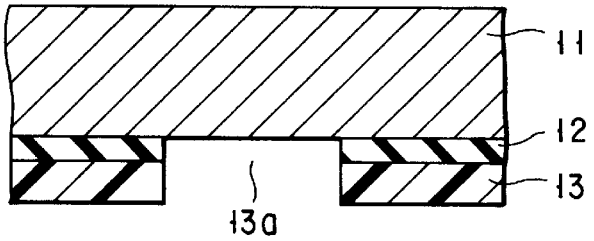

The resist layer 13 is patterned by exposure, development, and the like by using an aligner or the like to obtain a plurality of opening portions 13*a*, e.g., 10-μm square opening portions arranged in a matrix. The size of each opening portion 13*a* is about 2 μm to 300 μm square, and the distance among the opening portions 13*a* is about 0.1 μm to 300 μm, and preferably 100 μm or less. By using the resist layer 13 as a mask, the $SiO_2$ layer 12 is etched with an $NH_4F$—HF solution mixture (FIG. 4B).

Figure 4C:
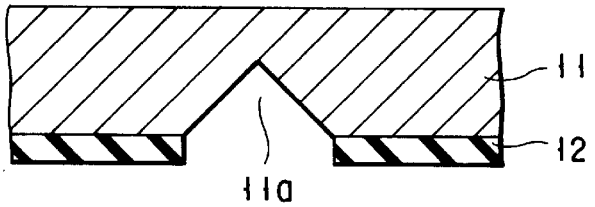

After the resist layer 13 is removed, anisotropic etching is performed by using 30 wt % of an aqueous KOH solution to form an inverted pyramidal first recessed portion 11*a* having a depth of 7.1 μm in the Si single-crystal substrate 11 (FIG. 4C).

Figure 4D:
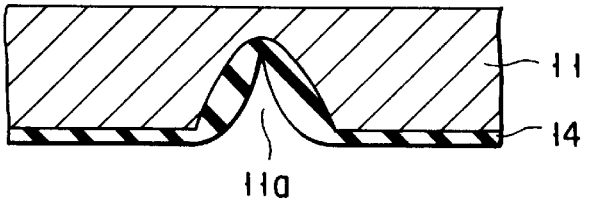

The $SiO_2$ oxide layer 12 is then removed by using an $NH_4F$—HF solution mixture, and an $SiO_2$ thermal oxide insulating layer 14 is formed on the Si single-crystal substrate 11 including the inner surface of the first recessed portion 11*a* (FIG. 4D). In this embodiment, the $SiO_2$ thermal oxide insulating layer 14 is formed by wet oxidization to have a thickness of 3 μm.

A resist is applied to a surface of the single-crystal substrate 11 on a side opposite to the first recessed portion 11*a* to form a resist layer, and the resist layer is patterned to form an opening portion in its portion opposing the first recessed portion 11*a*. The Si single-crystal substrate 11 is etched by reactive ion etching (RIE) to form a second recessed portion 11*b*. At this time, the bottom portion of the $SiO_2$ thermal oxide insulating layer 14, i.e., a pyramidal distal-end projecting portion 14*a*, is exposed.

Figure 4E:
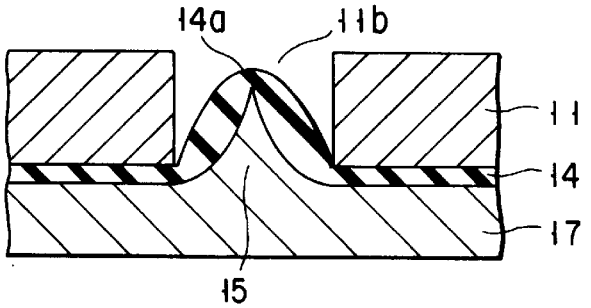
Figure 4F:
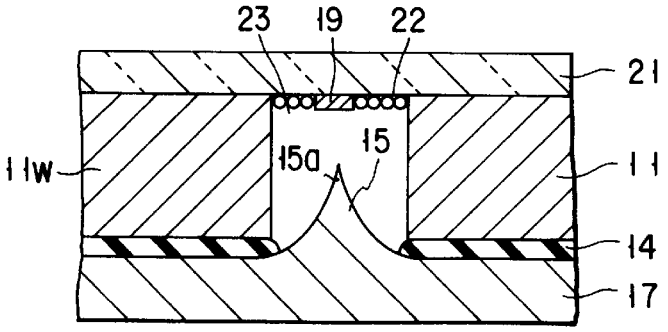

After the resist layer is removed, for example, a tungsten or molybdenum layer is formed as a conductive layer 17 made of an emitter material on the $SiO_2$ thermal oxide insulating layer 14 to fill the first recessed portion 11*a* (FIG. 4E). At this time, the pyramidal emitter 15 is formed to correspond to the first recessed portion 11*a*. The distal end portion 15*a* of the emitter 15 becomes sharp to have a radius of curvature of about 1 μm to 100 μm at its distal end due to the growth of the thermal oxide insulating layer 14 into the first recessed portion 11*a*. In this embodiment, a molybdenum layer is formed by sputtering to have a thickness of 20 μm. If the emitter 15 is to be formed of diamond, a diamond layer is formed on a region including the inner surface of the first recessed portion 11*a* by CVD.

In the structure shown in FIG. 4E, the conductive layer 17 serves as both the emitter 15 and a cathode electrode. However, the emitter 15 and the cathode electrode may be made of different materials. When forming the cathode electrode independently of the emitter 15, a conductive layer made of ITO, Ta, Al, or the like can be used.

The $SiO_2$ thermal oxide insulating layer 14 is selectively removed by using an $NH_4F$—HF solution mixture to expose the emitter 15. Finally, the glass substrate 21 on which the counter electrode 19 and the phosphor layer 22 are disposed is adhered to the single-crystal substrate 11 so as to oppose the distal end portion 15*a* of the emitter 15, thereby forming the plurality of discharge cells 23 in which a discharge gas, e.g., He—Ne, Ne—Xe, or He—Xe, is sealed. The distance among the plurality of discharge cells 23, i.e., the width of each partition wall 11*w* formed by the single-crystal substrate 11 becomes about 0.1 μm to 300 μm, and preferably 100 μm or less, in accordance with the distance among the resist layers 13. Note that the phosphor layer 22 can be formed to cover the side portions or bottom portions of the respective discharge cells 23 (the surface of the Si single-crystal substrate 11) so that it has a large area.

In this manner, in the manufacturing method shown in FIGS. 4A to 4F, the $SiO_2$ thermal oxide insulating layer 14 is formed on the Si single-crystal substrate 11 having the first recessed portion 11*a* formed by anisotropic etching, and thereafter the material 17 which will form the emitter is filled in the first recessed portion 11*a*. Therefore, the emitter 15 which conforms to the first recessed portion 11*a* can be obtained with a good reproducibility. Due to the shape reproducibility of anisotropic etching and the growth of the $SiO_2$ thermal oxide insulating layer 14 into the first recessed portion 11*a*, the first recessed portion 11*a* can have an inverted pyramidal shape having a pointed bottom portion. Accordingly, the pyramidal emitter 15 having the pointed distal end portion 15*a* and a uniform height can be obtained.

Different from the conventional manufacturing method using screen printing, in the manufacturing method shown in FIGS. 4A to 4F, the partition wall 11*w* can be made to have a thickness of about 0.1 μm to 200 μm, and the distance between the electrodes 15 and 19 can be made as small as about 1 μm to 200 μm. As a result, small discharge cells 23 each having a size of about 1 μm to 200 μm can be formed, and together with the use of a microplasma, a compact, high-resolution plasma display can be realized.

Figure 2:
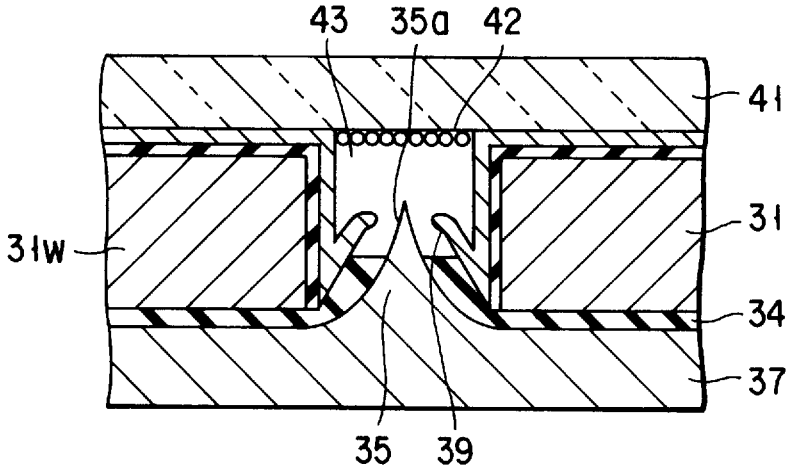
FIG. 2 is a sectional view illustrating a plasma display according to another embodiment of the present invention.

FIG. 2 is a sectional view illustrating a plasma display according to another embodiment of the present invention.

As shown in FIG. 2, the plasma display according to this embodiment has a plurality of discharge cells 43 arranged in a matrix. The discharge cells 43 are formed of an air-tight space sealed by a support substrate 31, a cathode electrode 37, and a transparent substrate 41, and storing a discharge gas, e.g., He—Ne, Ne—Xe, He—Xe, or the like. The distance among the discharge cells 43, i.e., the width of each partition wall 31*w* formed of the substrate 31 is set to about 0.1 μm to 300 μm, and preferably 100 μm or less. An emitter 35 for emitting electrons, and a counter electrode 39 placed above the emitter 35 through an insulating layer 34 are disposed in the discharge cell 43. Although only one emitter 35 is shown in FIG. 2, a plurality of emitters may be disposed in each discharge cell 43. When phosphor emission is utilized, in the discharge cell 43, a phosphor layer 42 is further disposed on, e.g., the glass substrate 41.

A distal end portion 35*a* of the emitter 35 is sharp with the radius of curvature at its distal end of about 1 μm to 100 μm. As the emitter material, a normal electrode material, e.g., molybdenum, tungsten, or Si, can be used, as described above. As the emitter material, a material having a low work function (a negative electron affinity), e.g., diamond, or ferroelectrics, e.g., PZT or PLZT, can also be used.

With the plasma display shown in FIG. 2, the same effect as that obtained with the plasma display shown in FIG. 1 can be obtained. Furthermore, since the emitter distal end portion 35*a* and the counter electrode 39 are formed to sandwich the insulating layer 34, the distance between the counter electrode and the emitter can be controlled highly accurately in accordance with the thickness of the insulating layer 34. Since the emitter distal end portion 35*a* and the counter electrode 39 are close to each other, a microplasma smaller than that obtained with the structure shown in FIG. 1 can be generated.

FIGS. 5A to 5E are sectional views illustrating a method of manufacturing the plasma display shown in FIG. 2 in the order of manufacturing steps. In the manufacturing method shown in FIGS. 5A to 5E, the cathode electrode and the emitter 35 are formed integrally.

Figure 5A:
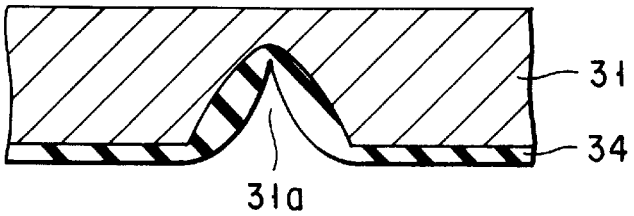
FIGS. 5A to 5E are sectional views illustrating a method of manufacturing the plasma display shown in FIG. 2 in the order of manufacturing steps.

In this manufacturing method, the structure shown in FIG. 5A is formed through the steps shown in FIGS. 4A to 4D. More specifically, the structure shown in FIG. 5A has a Si single-crystal substrate 31, a first recessed portion 31*a*, and an $SiO_2$ thermal oxide insulating layer 34 respectively corresponding to the substrate 11, the first recessed portion 11*a*, and the insulating layer 14 shown in FIG. 4D.

Figure 5B:
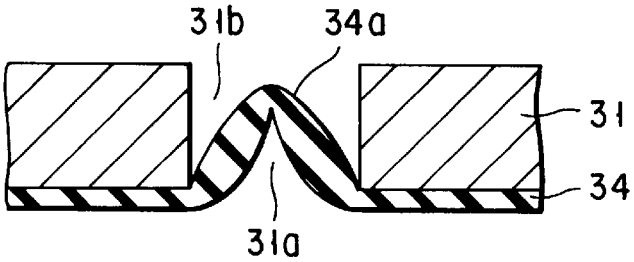

A resist is applied to a surface of the single-crystal substrate 31 on a side opposite to the first recessed portion 31*a* to form a resist layer, and the resist layer is patterned to form an opening portion in its portion opposing the first recessed portion 31*a*. The Si single-crystal substrate 31 is etched by reactive ion etching (RIE) to form a second recessed portion 31*b* (FIG. 5B). At this time, the bottom portion of the $SiO_2$ thermal oxide insulating layer 34, i.e., a pyramidal distal-end projecting portion 34*a*, is exposed.

Figure 5C:
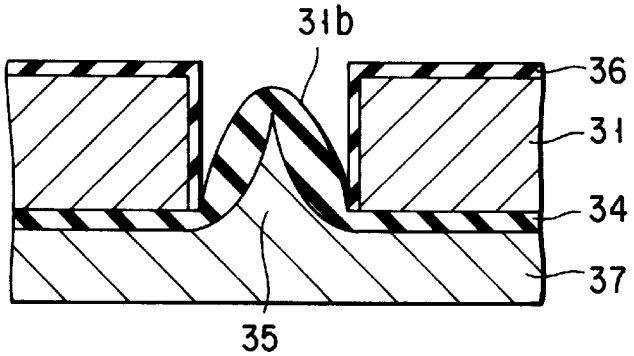

After the resist layer is removed, an insulating layer 36 is formed on the surface of the single-crystal substrate 31 including the inner surface of the second recessed portion 31*b*. In this embodiment, the $SiO_2$ thermal oxide insulating layer 36 is formed to have a thickness of 0.2 $\mu$m. The insulating layer 36 can be omitted. Furthermore, for example, a tungsten or molybdenum layer is formed as a conductive layer 37 made of an emitter material on the $SiO_2$ thermal oxide insulating layer 34 to fill the first recessed portion 31*a* (FIG. 5C). At this time, the pyramidal emitter 35 is formed to correspond to the first recessed portion 31*a*. The distal end portion 35*a* of the emitter 35 becomes sharp to have a radius of curvature of about 1 $\mu$m to 100 $\mu$m at its distal end additionally due to the growth of the thermal oxide insulating layer 34 into the first recessed portion 31*a*. In this embodiment, a molybdenum layer is formed by sputtering to have a thickness of 2 $\mu$m.

If the emitter 35 is to be formed of diamond, a diamond layer is formed on a region including the inner surface of the first recessed portion 31*a* by CVD.

Figure 5D:
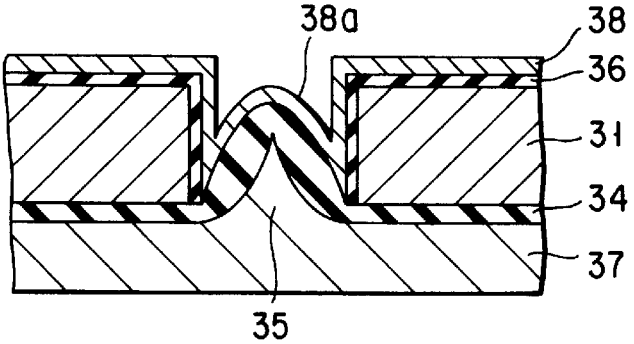
Figure 5E:
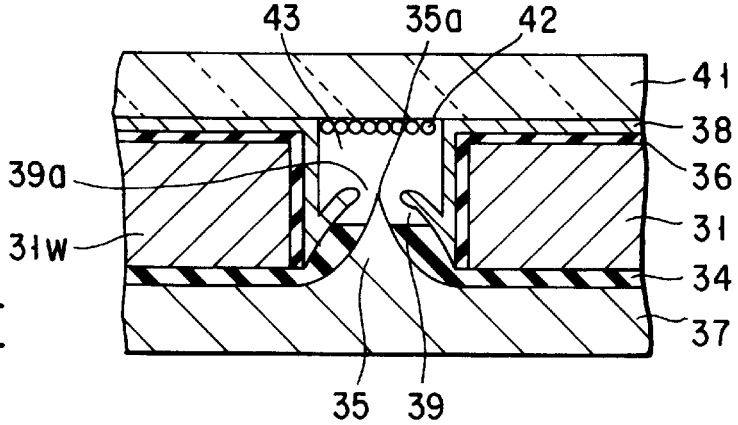
Figure 6:
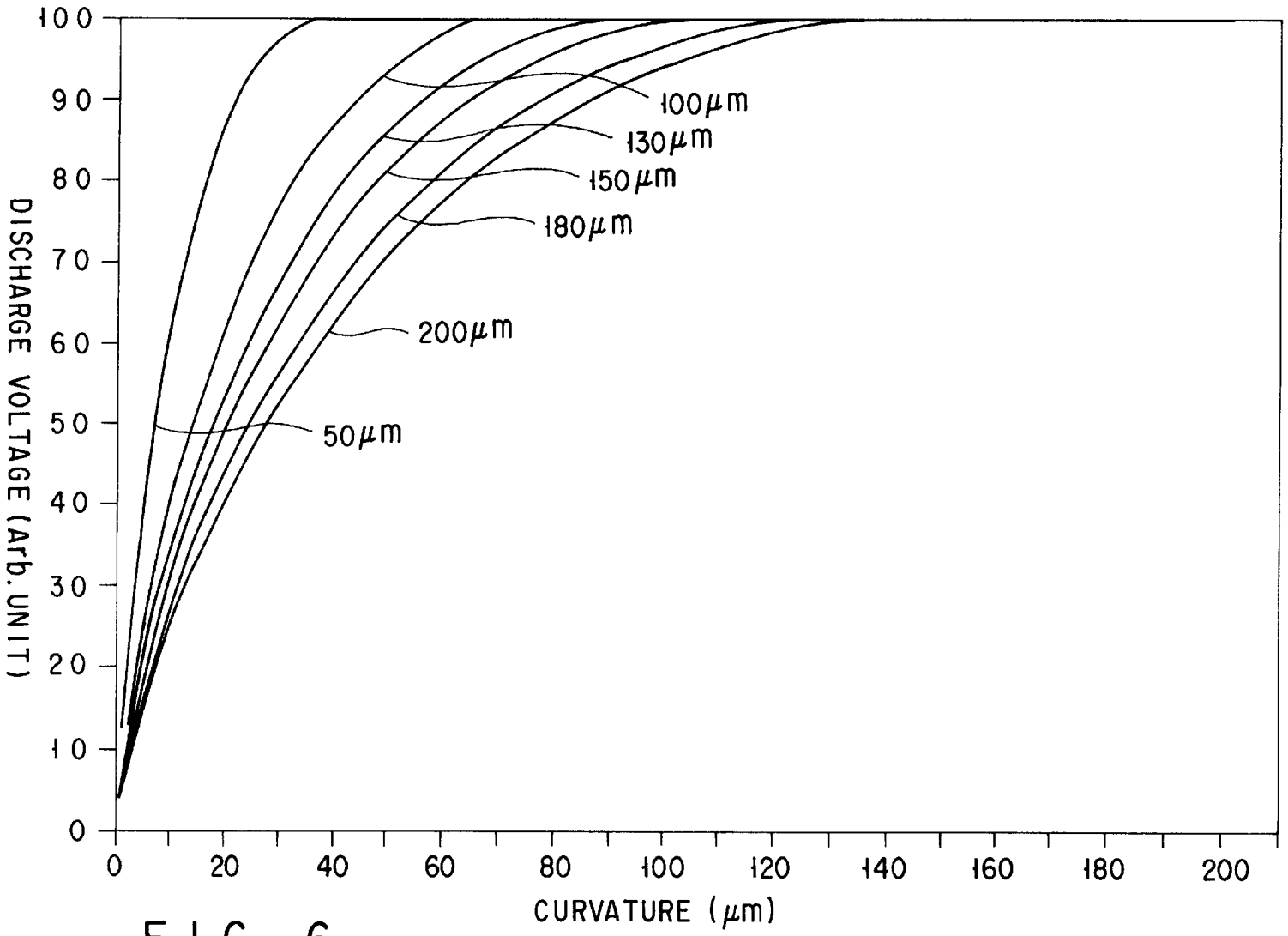
FIG. 6 a graph showing relationships between the radii of curvature of the distal end portion of a discharge electrode and the discharge voltages when the sealed discharge gas pressure is constant.

In the structure shown in FIG. 5E, the conductive layer 37 serves as both the emitter 35 and a cathode electrode. However, the emitter 35 and the cathode electrode may be made of different materials. When forming the cathode electrode independently of the emitter 35, a conductive layer made of ITO, Ta, Al, or the like can be used.

As a conductive layer 38 for a counter electrode, for example, a molybdenum layer is formed on the insulating layer 36 including the pyramidal distal-end projecting portion 34*a* of the $SiO_2$ thermal oxide insulating layer 34 and the inner surface of the second recessed portion 31*b* (FIG. 5D). In this embodiment, the molybdenum layer is formed by sputtering to have a thickness of 0.9 $\mu$m.

A resist is applied to the conductive layer 38 to form a resist layer. The resist layer is selectively dry-etched with an oxygen plasma to expose the distal end portion of a pyramidal projecting portion 38*a* of the conductive layer 38 by about 0.7 $\mu$m. Thereafter, the conductive layer 38 on the pyramidal distal-end projecting portion 34*a* is removed by reactive ion etching (RIE). The $SiO_2$ thermal oxide insulating layer 34 is selectively removed with an $NH_4F$—HF solution mixture by using the remaining resist layer or another resist layer as a mask. As a result, a counter electrode 39 having an opening portion 39*a* is formed, and the distal end portion 35*a* of the pyramidal emitter, i.e., the cold cathode 35, is exposed.

Finally, the glass substrate 41 on which a phosphor layer 42 is disposed is adhered to the single-crystal substrate 31 so as to oppose the distal end portion 35*a* of the emitter 35, thereby forming a plurality of discharge cells 43 in which a discharge gas, e.g., He—Ne, is sealed (FIG. 5E). The distance among the plurality of discharge cells 43, i.e., the width of each partition wall 31*w* formed by the single-crystal substrate 31 becomes about 0.1 $\mu$m to 300 $\mu$m, and preferably 100 $\mu$m or less, in accordance with the distance among the resist layers 13 (see FIGS. 4A and 4B). Note that the phosphor layer 42 can be formed to cover the side portions or bottom portions of the respective discharge cells 43 (the surfaces of the conductive layer 38 and the emitter 35) so that it has a large area.

In this manner, in the manufacturing method shown in FIGS. 5A to 5E, the pyramidal emitter 35 having the pointed distal end portion 35*a* and a uniform height can be stably obtained in the same manner as in the manufacturing method shown in FIGS. 4A to 4F. Further, since the emitter distal end portion 35*a* and the counter electrode 39 are formed to sandwich the $SiO_2$ thermal oxide insulating layer 34, the distance between the counter electrode and the emitter can be controlled highly accurately in accordance with the thickness of the insulating layer 34.

Figure 3:
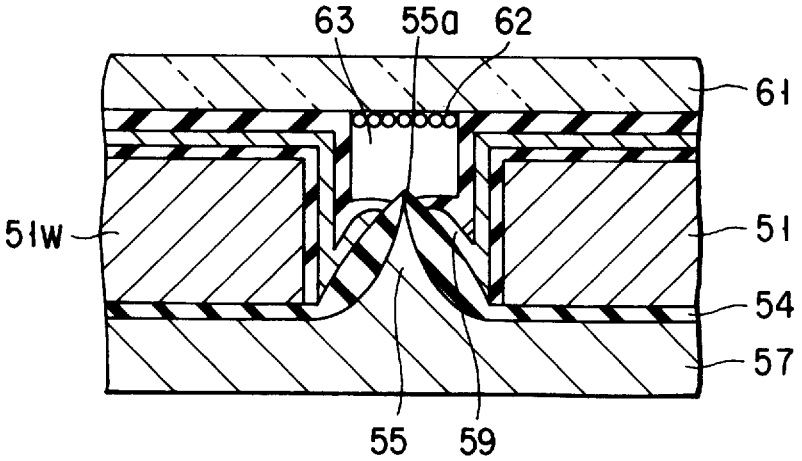
FIG. 3 is a sectional view illustrating a plasma display according to still another embodiment of the present invention.

FIG. 3 is a sectional view illustrating a plasma display according to still another embodiment of the present invention.

As shown in FIG. 3, the plasma display according to this embodiment has a plurality of discharge cells 63 arranged in a matrix. The discharge cells 63 are formed of an air-tight space sealed by a support substrate 51, a cathode electrode 57, and a transparent substrate 61, and storing a discharge gas, e.g., He—Ne, Ne—Xe, He—Xe, or the like. The distance among the discharge cells 63, i.e., the width of each partition wall 51*w* formed of the substrate 51 is set to about 0.1 $\mu$m to 300 $\mu$m, and preferably 100 $\mu$m or less. An emitter 55 for emitting electrons, and a counter electrode 59 placed on the emitter 55 through an insulating layer 54 are disposed in the discharge cell 63. The emitter 55 is not exposed from the insulating layer 54 but is covered completely. An $SiO_2$ insulating layer 60 is disposed to cover the counter electrode 59. Although only one emitter 55 is shown in FIG. 3, a plurality of emitters may be disposed in each discharge cell 63. When phosphor emission is utilized, in the discharge cell 63, a phosphor layer 62 is further disposed on, e.g., the glass substrate 61.

A distal end portion 55*a* of the emitter 55 is sharp with the radius of curvature at its distal end of about 1 $\mu$m to 100 $\mu$m. As the emitter material, a normal electrode material, e.g., molybdenum, tungsten, or Si, can be used, as described above. As the emitter material, a material having a low work function (a negative electron affinity), e.g., diamond, or ferroelectrics, e.g., PZT or PLZT, can also be used.

With the plasma display shown in FIG. 3, the same effect as that obtained with the plasma display shown in FIG. 2 can be obtained. Furthermore, since the emitter 55 and the counter electrode 59 are respectively covered with the insulating layers 54 and 60, they are protected from the plasma in the cell. Hence, a plasma display having a long service life can be provided. In this case, the plasma may be maintained by applying an AC voltage.

A method of manufacturing the plasma display shown in FIG. 3 is similar to the manufacturing method shown in FIGS. 5A to 5E. The difference is that, in the step shown in FIG. 5D, after the opening portion for the counter electrode is formed, the $SiO_2$ insulating layer 60 is further formed, and in the subsequent step, when etching the $SiO_2$ insulating layer 60 and a portion above the emitter 55 of the counter electrode 59, the insulating layer 54 is left.

Figure 7:
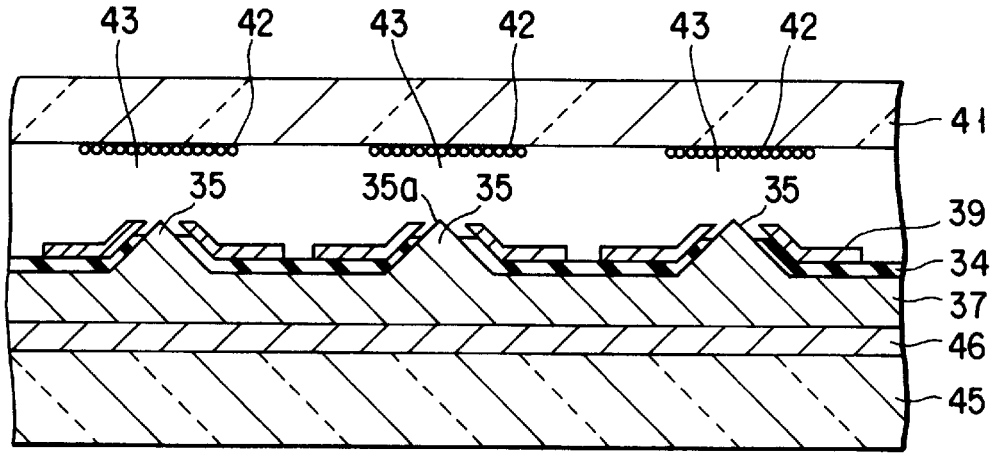
FIG. 7 is a sectional view illustrating a plasma display according to still another embodiment of the present invention.

FIG. 7 is a sectional view illustrating a plasma display according to still another embodiment of the present invention.

As shown in FIG. 7, the plasma display of this embodiment has a structure obtained by removing from the plasma display shown in FIG. 2 the partition walls 31*w* partitioning the emitters 35. In FIG. 7, portions corresponding to equivalent components in FIG. 2 are denoted by the same reference numerals, and a detailed description thereof will be omitted. Additional reference numerals 45 and 46 respectively denote a support glass substrate and an ITO conductive layer.

In the plasma displays of the present invention, since the distance between the distal end portion of the emitter and the counter electrode can be decreased, a plasma can be locally generated between them, and in some cases, a plasma can be generated by Townsend discharge providing a high ultraviolet generation efficiency. Thus, even if the partition walls among the discharge cells are not present, the respective discharge cells can locally generate microplasmas without interfering with each other. More specifically, in the plasma displays shown in FIGS. 1 to 3, the partition walls 11*w*, 31*w*, and 51*w* can be omitted. FIG. 7 shows a plasma display of such an example, in which the structure shown in FIG. 2 is modified.

In the present invention, as described above, the term "discharge cell" means the discharge area arranged in an air-tight space to correspond to a plurality of pixels arranged in a matrix to display an image. Accordingly, a discharge area corresponding to the pixels is expressed by unit "discharge cell" even when no partition walls are present in this manner.

FIGS. 8A to 8H are sectional views illustrating an embodiment of a method of manufacturing an emitter of the plasma display shown in FIG. 7 in the order of manufacturing steps.

In this manufacturing method, first, a recessed portion 72 having a pointed bottom portion is formed in one surface of a single-crystal substrate 71. To form such a recessed portion, a method utilizing anisotropic etching of an Si single-crystal substrate as described below is available.

More specifically, an $SiO_2$ thermal oxide layer is formed to a thickness of 0.1 $\mu$m on the p-type Si single-crystal substrate 71 having a crystal face orientation of (100) by dry oxidization. Subsequently, a resist is applied to the thermal oxide layer by spin coating to form a resist layer.

The resist layer is patterned by exposure, development, and the like by using an aligner or the like to obtain a plurality of opening portions, e.g., 10-$\mu$m square opening portions arranged in a matrix. The size of each opening portion is about 2 $\mu$m to 300 $\mu$m square. By using the resist layer as a mask, the $SiO_2$ film is etched with an $NH_4F$—HF solution mixture.

Figure 8A:
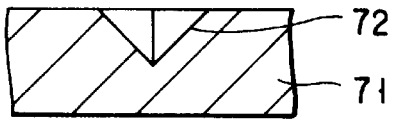
FIGS. 8A to 8H are sectional views illustrating a method of manufacturing an emitter of the plasma display shown in FIG. 7 in the order of manufacturing steps.

After the resist layer is removed, anisotropic etching is performed by using 30 wt % of an aqueous KOH solution to form a recessed portion 72 having a depth of 7.1 $\mu$m in the Si single-crystal substrate 71 (FIG. 8A). Subsequently, the $SiO_2$ oxide layer is removed by using an $NH_4F$—HF solution mixture. When etching is performed with the aqueous KOH solution, the recessed portion 72 has an inverted pyramidal shape defined by four inclined surfaces having (111) planes.

Subsequently, the Si single-crystal substrate 71 formed with the recessed portion 72 is thermally oxidized by, e.g., wet oxidization, to form an $SiO_2$ thermal oxide insulating layer 73 on the entire surface including the recessed portion 72 to a thickness of, e.g., 0.5 $\mu$m. Although the insulating layer 73 can be formed by deposition in accordance with CVD, an $SiO_2$ thermal oxide film is preferable because it is dense and its thickness and the like can be controlled easily.

Figure 8B:
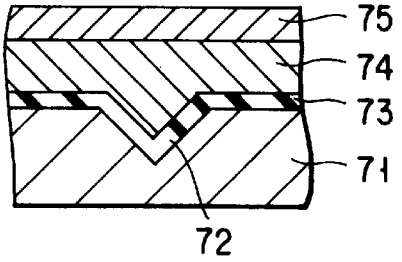
Figure 8C:
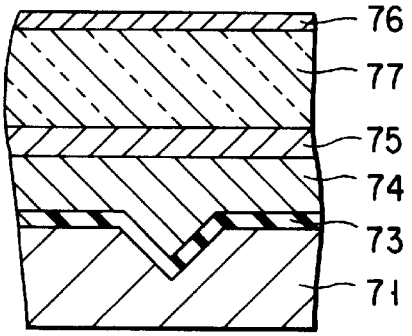

An emitter material layer 74 made of tungsten, molybdenum, diamond, or the like and a conductive layer 75 made of ITO or the like are formed on the single-crystal substrate, i.e., the Si single-crystal substrate 71, to fill the recessed portion 72 (FIG. 8B). The emitter material layer 74 and the conductive layer 75 are formed by, e.g., sputtering, to a thickness of 2 $\mu$m and 1 $\mu$m, respectively.

The emitter material layer 74 is formed to sufficiently fill the recessed portion 72 and to have a uniform thickness on portions other than the recessed portion 72 as well. When the emitter is to be formed of diamond, a diamond layer is formed by CVD as the emitter material layer 74. The conductive layer 75 can be omitted depending on the material of the emitter material layer 74. In this case, the emitter material layer 74 also serves as the cathode electrode.

A pyrex glass substrate (having a thickness of 1 mm) 77 coated with, e.g., a 0.3-$\mu$m thick Al layer 76 on its rear surface, is prepared as a support substrate. The glass substrate 77 and the Si single-crystal substrate 71 are adhered to each other so as to sandwich the emitter material layer 74 (FIG. BC). For example, electrostatic adhesion can be employed for this adhesion. Electrostatic adhesion contributes to a decrease in weight and a reduction in height of the emitter structure.

Figure 8D:
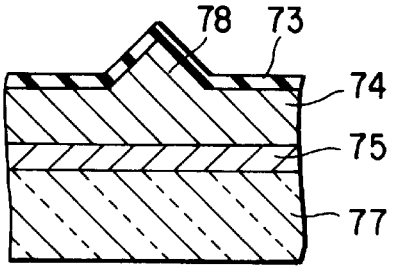

The Al layer 76 on the rear surface of the glass substrate 77 is removed with an acid solution mixture of $HNO_3$, $CH_3COOH$, and HF. The Si single-crystal substrate 71 is removed by etching with an aqueous solution comprising ethylenediamine, pyrocatechol, and pyrazine (ethylenediamine:pyrocatechol:pyrazine water=75 cc:12 g:3 mg:10 cc). In this manner, the $SiO_2$ thermal oxide insulating layer 73 covering a pyramidal conductive projecting portion 78 is exposed (FIG. 8D).

Figure 8E:
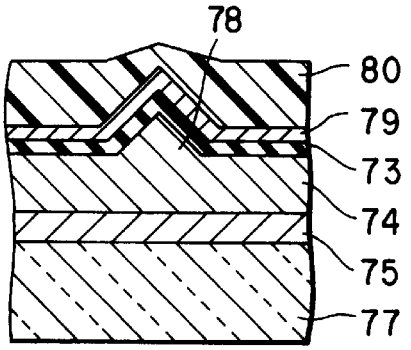

A conductive material layer 79 comprising a conductive material, e.g., W, to serve as a counter electrode is formed on the insulating layer 73 by, e.g., sputtering, to a thickness of about 0.5 $\mu$m. Thereafter, a photoresist layer 80 is formed by coating on the conductive material layer 79 by, e.g., spin coating, to a thickness of about 0.9 $\mu$m enough to cover the distal end of the pyramid (FIG. 8E).

Figure 8F:
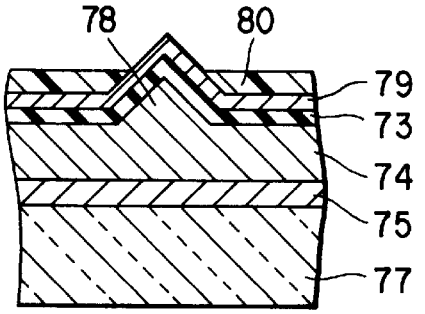
Figure 8G:
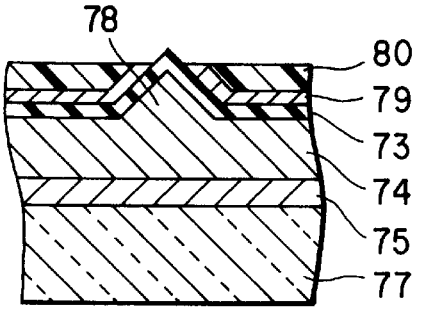

Dry etching using an oxygen plasma is performed to remove the photoresist layer 80 so that the distal end portion of the pyramid appears by about 0.7 $\mu$m (FIG. 8F). Thereafter, the conductive material layer 79 at the distal end portion of the pyramid is etched by reactive ion etching to form an opening portion (FIG. 8G).

Figure 8H:
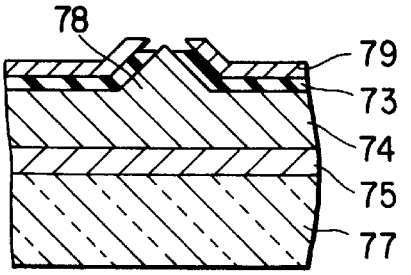

After the photoresist layer 80 is removed, the insulating layer 73 is selectively removed by using an $NH_4F$—HF solution mixture. In this manner, the distal end portion of the conductive projecting portion 78 is exposed in the opening portion of the conductive material layer 79 serving as the counter electrode (FIG. 8H). The structure shown in FIG. 8H corresponds to the structure of the emitter 35 side of the plasma display shown in FIG. 7. More specifically, the conductive projecting portion 78 and the conductive material layer 79 in FIG. 8H correspond to the emitter 35 and a counter electrode 39, respectively, in FIG. 7.

Accordingly, as shown in FIG. 7, a glass substrate 41 on which a phosphor layer 42 is disposed is finally adhered to a glass substrate 45 so as to oppose a distal end portion 35*a* of the emitter 35, and a discharge gas, e.g., He—Ne, Ne—Xe, He—Xe, or the like is sealed, thus completing a plasma display.

Figure 9:
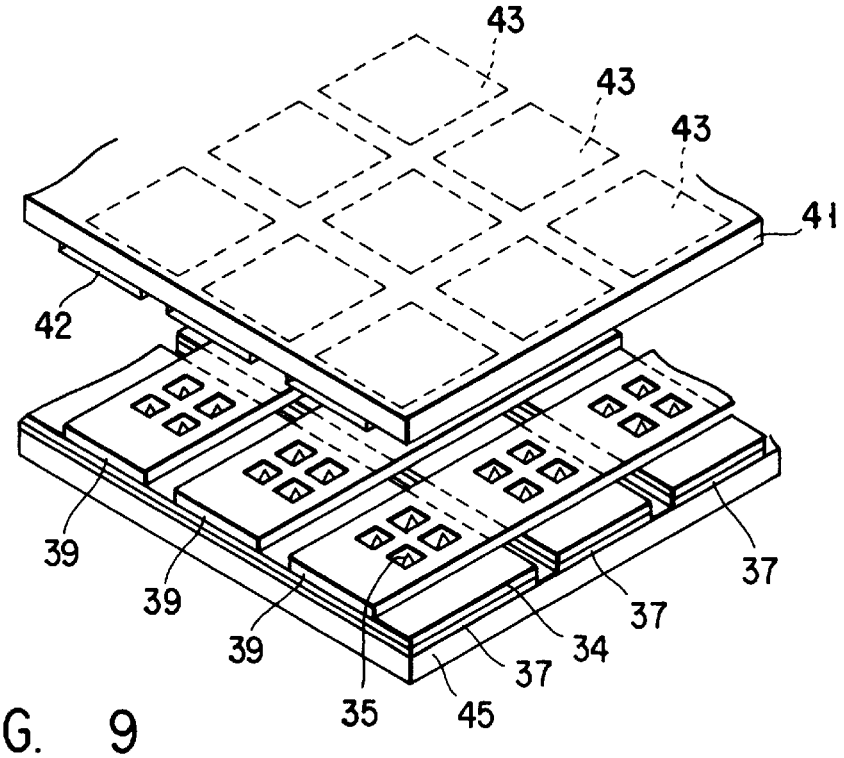
FIG. 9 is a developed perspective view showing a plasma display according to still another embodiment of the present invention.

FIG. 9 is a developed perspective view showing a plasma display according to still another embodiment of the present invention.

As shown in FIG. 9, the plasma display of this embodiment is obtained by applying the structure shown in FIG. 7. Each of a plurality of discharge cells 43 arranged in a matrix has four emitters 35. In FIG. 9, portions corresponding to equivalent components in FIG. 7 are denoted by the same reference numerals, and a detailed description thereof will be omitted.

As shown in FIG. 9, the lines of cathode electrodes 37 connected to the emitters 35 and the lines of counter electrodes 39 are perpendicular to each other, and the discharge cells 43 are arranged on their intersections. Accordingly, when the voltages across the electrodes of the discharge cells 43 are arbitrarily set through the lines of the cathode electrodes 37 and the lines of the counter electrodes 39, the ON and OFF states of the pixels can be selected. More specifically, the pixels can be selected in accordance with so-called matrix driving by line-sequentially selecting the lines of, e.g., the counter electrodes 39, to apply a predetermined potential to them, and by applying predetermined potentials as selection signals to the lines of the cathode electrodes 37 in synchronism with selection of the lines of the counter electrodes 39.

The present invention is not limited to this embodiment, but in any of the plasma displays shown in FIGS. 1 to 3 and FIG. 7, the lines of the cathode electrodes and the lines of the counter electrodes can be arranged perpendicularly. Then, matrix driving can be performed in the same manner as in the embodiment shown in FIG. 9.

According to the embodiments described with reference to FIGS. 1 to 9, a plasma display in which the drive voltage is low, the phosphor brightness is high, the drive circuit is simple, the problem of heat dissipation is solved, and pixels can be micro-patterned, and a manufacturing method thereof can be provided.

Figure 10:
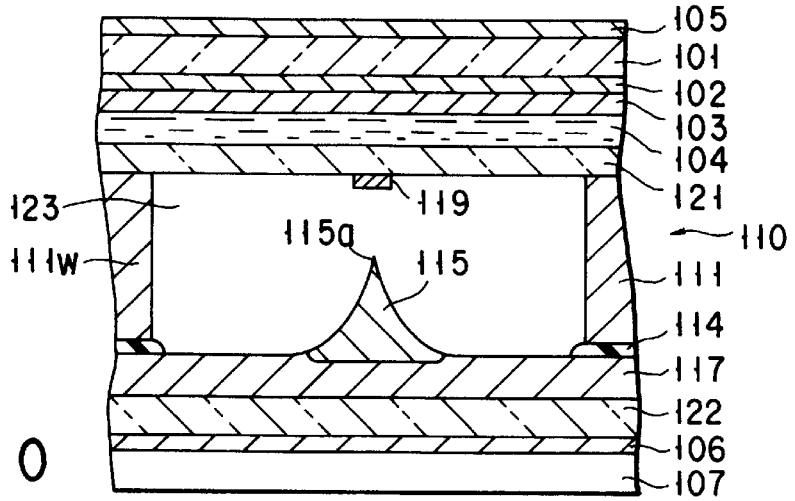
FIG. 10 is a sectional view illustrating a plasma liquid crystal display according to still another embodiment of the present invention.

FIG. 10 is a sectional view illustrating a plasma liquid crystal display according to still another embodiment of the present invention.

The plasma liquid crystal display according to this embodiment has a discharge cell array block 110 divided into a plurality of discharge cells 123 arranged in a matrix. As shown in FIG. 10, the discharge cells 123 are formed of an air-tight space sealed by opposing glass substrates 121 and 122, which are transparent and dielectric, and a spacer substrate 111 disposed between the glass substrates 121 and 122, and storing a discharge gas, e.g., He—Ne, He—Xe, Ne—Xe, or the like. The distance among the discharge cells 123, i.e., the width of each partition wall 111*w* formed of the substrate 111 is set to about 0.1 $\mu$m to 100 $\mu$m.

An emitter 115 connected to a cathode electrode 117 to emit electrons, and a counter electrode 119 formed on the glass substrate 121 so as to oppose the emitter 115 are disposed in the discharge cell 123. Although only one emitter 115 is shown in FIG. 10, a plurality of emitters may be disposed in each discharge cell 123. When a backlight is not used or when a transparent electrode is used, the emitter 115 and the cathode electrode 117 can be formed of the same material.

A glass substrate 101 is disposed to oppose the upper surface of the upper glass substrate 121. A stripe-like transparent electrode 102 and a color filter 103 are supported on the inner surface of the glass substrate 101. Between the glass substrate 121 and the glass substrate 101, a spacer is formed by spraying, and a liquid crystal is injected to form a liquid crystal layer 104 having a transmittance that changes in accordance with a change in applied voltage. Polarization plates 105 and 106 are disposed on the outer surfaces of the uppermost glass substrate 101 and the lowermost glass substrate 122, respectively. Furthermore, a backlight 107 is disposed on the rear surface side of the lowermost glass substrate 122. These components 101 to 107 are used in a general liquid crystal display device. Each discharge cell 123 serves as a switching element that changes, with electric potential obtained on the glass substrate 121 by converting the discharge gas into a plasma, the state of the liquid crystal layer 104 so as to correspond to the corresponding pixel.

When only light emitted by the discharge gas plasma is utilized or when a phosphor is arranged in each discharge cell 123 and its fluorescence is utilized, the polarization plate 106 may be placed on the upper portion of the glass substrate 121 and the backlight 107 may be omitted.

A distal end portion 115*a* of the emitter 115 disposed in the discharge cell 123 has a pointed shape having a radius of curvature at its distal end of about 1 $\mu$m to 100 $\mu$m. As the emitter material, a normal electrode material, e.g., molybdenum, tungsten, or Si, can be used. As the emitter material, various types of materials having low work functions can also be used. An example of the material having a low work function includes diamond which has a negative electron affinity (an apparent negative work function) to emit electrons easily, can obtain a large current, is resistant against ion impact, is chemically stable, and is substantially free from the influence of gas adsorption. Ferroelectrics, e.g., PZT (lead zirconate titanate) or PLZT (lead lanthanum zirconate titanate), which can emit a large current upon polarization inversion, is resistant against ion impact in the same manner as diamond, is chemically stable, and is substantially free from the influence of gas adsorption, can also be used.

In the plasma liquid crystal display shown in FIG. 10, when compared to a conventional plasma liquid crystal display using parallel-plate electrodes and employing Ni (work function: 5.15 eV), Al (work function: 4.28 eV), or Mo (work function: 4.6 eV) having a large work function as the electrode material, the electric field is concentrated on the distal end portion 115*a* of the pointed emitter, i.e., the projecting electrode 115, so that electrons are emitted easily, thus generating a discharge plasma. Accordingly, the discharge voltage, i.e., the drive voltage, can be decreased from the conventional value ranging from 150 V to 400 V, and normally 250 V to 400 V, to 25 V to 135 V. As a result, the drive circuit becomes simple, and the power consumption can be largely decreased. Then, heat generation is decreased, which is effective as the heat dissipation countermeasure and for a low-profile structure.

Since the projecting emitter, i.e., the electrode 115 is used, the distance between the electrodes can be decreased by controlling the discharge voltage and the gas pressure or decreasing the radius of curvature of the distal end portion 115*a* of the projecting electrode 115, unlike in the case using the parallel-plate electrodes, while maintaining the gas pressure to substantially a constant value without largely increasing it, unlike in the conventional case. Accordingly, a small microplasma having a discharge area with a diameter of about 1 $\mu$m to 200 $\mu$m can be generated. As a result, the discharge cells can be micropatterned, thus contributing to a reduction in height.

FIGS. 13A to 13F are sectional views illustrating a method of manufacturing the discharge cell array block 110 of the plasma liquid crystal display shown in FIG. 10 in the order of manufacturing steps.

First, the first recessed portion having a pointed bottom portion is formed in one surface of a single-crystal substrate. To form such a recessed portion, a method utilizing anisotropic etching of an Si single-crystal substrate to be described below is available.

Figure 13A:
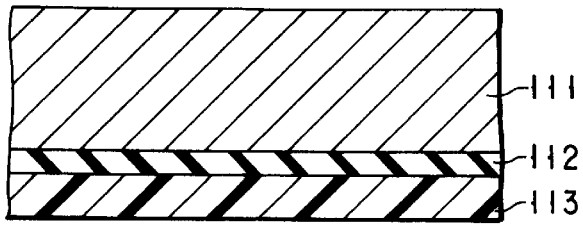
FIGS. 13A to 13F are sectional views illustrating a method of manufacturing the discharge cell array block of the plasma liquid crystal display shown in FIG. 10 in the order of manufacturing steps.

More specifically, an $SiO_2$ thermal oxide layer 112 is formed to a thickness of 0.1 μm on the p-type Si single-crystal substrate 111 having a crystal face orientation of (100) by dry oxidization. Subsequently, a resist is applied to the thermal oxide layer 112 by spin coating to form a resist layer 113 (FIG. 13A).

Figure 13B:
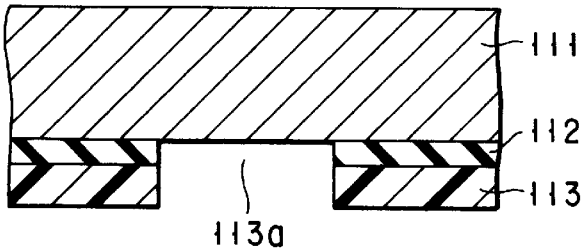

The resist layer 113 is patterned by exposure, development, and the like by using an aligner or the like to obtain a plurality of opening portions 113*a*, e.g., 10-μm square opening portions arranged in a matrix. The size of each opening portion 113*a* is about 2 μm to 300 μm square, and the distance among the opening portions 113*a* is about 0.1 μm to 100 μm. By using the resist layer 113 as a mask, the $SiO_2$ film 112 is etched with an $NH_4F$—HF solution mixture (FIG. 13B).

Figure 13C:
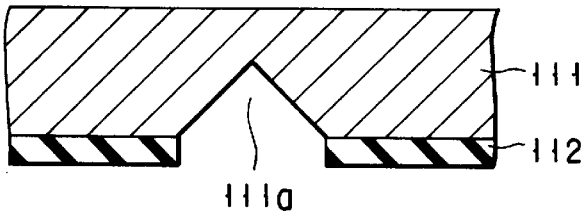

After the resist layer 113 is removed, anisotropic etching is performed by using 30 wt % of an aqueous KOH solution to form an inverted pyramidal first recessed portion 111*a* having a depth of 7.1 μm in the Si single-crystal substrate 111 (FIG. 13C).

Figure 13D:
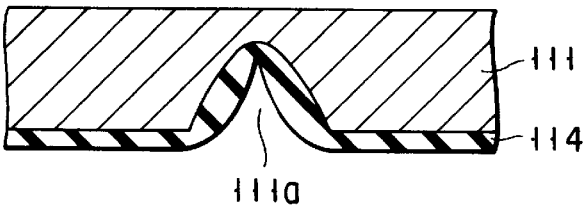

The $SiO_2$ oxide layer 112 is then removed by using an $NH_4F$—HF solution mixture, and an $SiO_2$ thermal oxide insulating layer 114 is formed on the Si single-crystal substrate 111 including the inner surface of the first recessed portion 11*a* (FIG. 13D). In this embodiment, the $SiO_2$ thermal oxide insulating layer 114 is formed by wet oxidization to have a thickness of 3 μm. The insulating layer 114 can be formed by CVD or anodization as well.

A resist is applied to a surface of the single-crystal substrate 111 on a side opposite to the first recessed portion 111*a* to form a resist layer, and the resist layer is patterned to form an opening portion in its portion opposing the first recessed portion 111*a*. The Si single-crystal substrate 111 is etched by reactive ion etching (RIE) to form a second recessed portion 111*b*. At this time, the bottom portion of the $SiO_2$ thermal oxide insulating layer 114, i.e., a pyramidal distal-end projecting portion 14*a*, is exposed.

After the resist layer is removed, an emitter material, e.g., tungsten, molybdenum, or preferably diamond, having a low work function (a negative electron affinity), or ferroelectrics, e.g., PZT or PLZT, is formed on the $SiO_2$ thermal oxide insulating layer 114 to fill the first recessed portion 111*a*. At this time, the pyramidal emitter 115 is formed to correspond to the first recessed portion 111*a*. The distal end portion 115*a* of the emitter 115 becomes sharp to have a radius of curvature of about 1 μm to 100 μm at its distal end due to the growth of the thermal oxide insulating layer 114 into the first recessed portion 111*a*. In this embodiment, a diamond layer is formed by CVD.

Figure 13E:
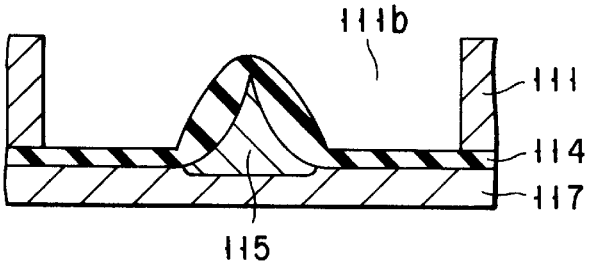

A layer made of a transparent conductive material, e.g., ITO, is deposited on the emitter 115 and the $SiO_2$ thermal oxide insulating layer 114 to form the cathode electrodes 117 (FIG. 13E). Although the emitter 115 and the cathode electrodes 117 are made of different materials in the structure shown in FIG. 13E, they may be made integrally of the same conductive material.

The $SiO_2$ thermal oxide insulating layer 114 is selectively removed with an $NH_4F$—HF solution mixture to expose the emitter 115. The glass substrate 122 is adhered to the cathode electrode 117 side as the support substrate. If the cathode electrode 117 itself serves as the support body for forming the air-tight discharge cells 123, the glass substrate 122 can be omitted.

Figure 13F:
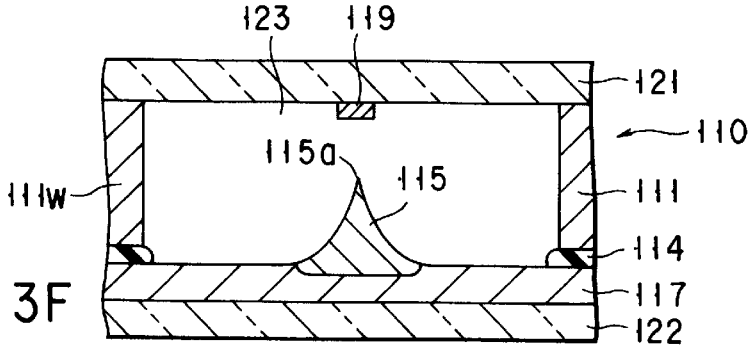

The glass substrate 121 on which the counter electrode 119 is disposed is adhered to the glass substrate 122 through the single-crystal substrate 111 so as to oppose the distal end portion 115*a* of the emitter 115, thereby forming the plurality of discharge cells 123 in which a discharge gas, e.g., He—Ne, He—Xe, or Ne—Xe, is sealed (FIG. 13F). The distance among the plurality of discharge cells 123, i.e., the width of each partition wall 111*w* formed of the single-crystal substrate 111 becomes about 0.1 μm to 100 μm in accordance with the distance among the resist layers 113.

Finally, as shown in FIG. 10, the glass substrate 101 for supporting the stripe-like transparent electrode 102 and the color filter 103 on its inner surface is disposed on the upper surface of the upper glass substrate 121 to oppose it. Between the glass substrates 121 and 101, a spacer is formed by spraying, and a liquid crystal is injected to form the liquid crystal layer 104 having a transmittance that changes in accordance with a change in applied voltage. The polarization plates 105 and 106 are disposed on the outer surfaces of the uppermost glass substrate 101 and the lowermost glass substrate 122, respectively. Furthermore, the backlight 107 is disposed on the rear surface side of the lowermost glass substrate 122. These components 101 to 107 are disposed on and under the discharge cell array block 110 in accordance with various known methods.

In this manner, in the manufacturing method shown in FIGS. 13A to 13F, the $SiO_2$ thermal oxide insulating layer 114 is formed on the Si single-crystal substrate 111 having the first recessed portion 111*a* formed by anisotropic etching, and thereafter a material that forms the emitter 115 is filled in the recessed portion 111*a*. Therefore, the emitter 115 conforming to the first recessed portion 111*a* can be obtained with a good reproducibility. Due to the shape reproducibility of anisotropic etching and the growth of the $SiO_2$ thermal oxide insulating layer 114 into the first recessed portion 111*a*, the first recessed portion 111*a* can have an inverted pyramidal shape having a well-sharpened bottom portion. Accordingly, the pyramidal emitter 115 having the pointed distal end portion 115*a* and a uniform height can be stably obtained. Even if the thermal oxide insulating layer 114 is formed by CVD or anodization, the same effect can be obtained.

Different from the conventional manufacturing method using screen printing, in the manufacturing method shown in FIGS. 13A to 13F, each partition wall 111*w* can be made to have a thickness of about 0.1 μm to 200 μm, and the distance between the electrodes 115 and 119 can be made as small as about 1 μm to 200 μm. As a result, small discharge cells 123 each having a size of about 1 μm to 200 μm can be formed, and together with the use of a microplasma, a compact, high-resolution plasma liquid crystal display can be realized.

Figure 11:
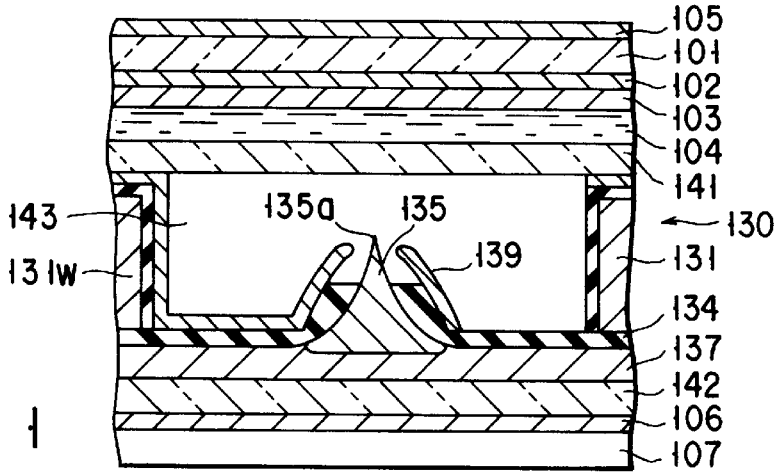
FIG. 11 is a sectional view illustrating a plasma liquid crystal display according to still another embodiment of the present invention.

FIG. 11 is a sectional view illustrating a plasma liquid crystal display according to still another embodiment of the present invention. In FIG. 11, sections that form an angle of 90° are joined at the center.

The plasma liquid crystal display according to this embodiment has a discharge cell array block 130 divided into a plurality of discharge cells 143 arranged in a matrix. As shown in FIG. 11, the discharge cells 143 are formed of an air-tight space sealed by opposing glass substrates 141 and 142, which are transparent and dielectric, and a spacer substrate 131 disposed between the glass substrates 141 and 142, and storing a discharge gas, e.g., He—Ne, He—Xe, Ne—Xe, or the like. The distance among the discharge cells 143, i.e., the width of each partition wall 131*w* formed of the substrate 131 is set to about 0.1 μm to 100 μm.

An emitter 135 connected to a cathode electrode 137 to emit electrons, and a counter electrode 139 formed on the emitter electrode 135 through an insulating layer 134 are disposed in the discharge cell 143. Although only one emitter 135 is shown in FIG. 11, a plurality of emitters may be disposed in each discharge cell 143. When a backlight is not used or when a transparent electrode is used, the emitter 135 and the cathode electrode 137 can be formed of the same material.

Components such as an opposing glass substrate 101, a backlight 107, and the like are disposed on and under the discharge cell array block 130, in the same manner as in the plasma liquid crystal display shown in FIG. 10.

A distal end portion 135*a* of the emitter 135 disposed in the discharge cell 143 is sharp to have a radius of curvature of about 1 μm to 100 μm at its distal end. As described above, as the emitter material, a normal electrode material, e.g., molybdenum, tungsten, Si, or the like can be used. As the emitter material, a material having a low work function (a negative electron affinity), e.g., diamond, or ferroelectrics, e.g., PZT or PLZT, can be used.

With the plasma liquid crystal display shown in FIG. 11, the same effect as that obtained with the plasma liquid crystal display shown in FIG. 10 can be obtained. Furthermore, since the emitter distal end portion 135*a* and the counter electrode 139 are formed to sandwich the insulating layer 134, the distance between the counter electrode and the emitter can be controlled highly precisely in accordance with the thickness of the insulating layer 134. Since the emitter distal end portion 135*a* and the counter electrode 139 are close to each other, a smaller microplasma than that obtained with the structure shown in FIG. 10 can be generated.

FIGS. 14A to 14E are diagrams illustrating a method of manufacturing the discharge cell array block 130 of the plasma liquid crystal display shown in FIG. 11 in the order of manufacturing steps.

Figure 14A:
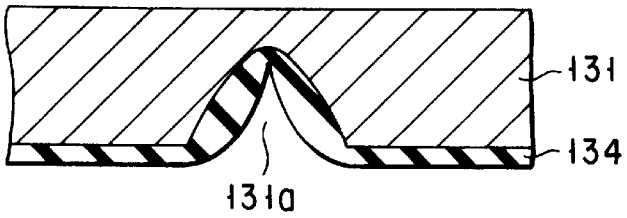
FIGS. 14A to 14E are sectional views illustrating a method of manufacturing the discharge cell array block of the plasma liquid crystal display shown in FIG. 11 in the order of manufacturing steps.

In this manufacturing method, the structure shown in FIG. 14A is formed through the steps shown in FIGS. 13A to 13D. More specifically, the structure shown in FIG. 14A has the Si single-crystal substrate 131, a first recessed portion 131*a*, and an $SiO_2$ thermal oxide insulating layer 134 respectively corresponding to the substrate 111, the first recessed portion 111*a*, and the insulating layer 114 shown in FIG. 13D.

Figure 14B:
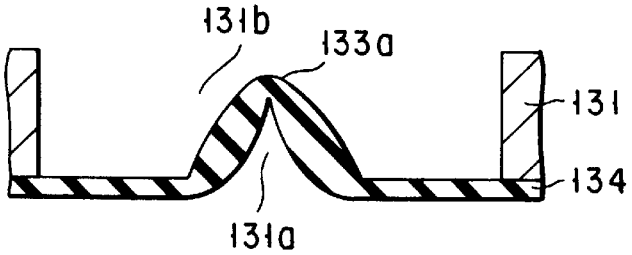

A resist is applied to a surface of the single-crystal substrate 131 on a side opposite to the first recessed portion 131*a* to form a resist layer, and the resist layer is patterned to form an opening portion in its portion opposing the first recessed portion 131*a*. The Si single-crystal substrate 131 is etched by reactive ion etching (RIE) to form a second recessed portion 131*b* (FIG. 14B). At this time, the bottom portion of the $SiO_2$ thermal oxide insulating layer 134, i.e., a pyramidal distal-end projecting portion 134*a*, is exposed.

After the resist layer is removed, an insulating layer 136 is formed on the surface of the single-crystal substrate 131 including the inner surface of the second recessed portion 131*b*. In this embodiment, the $SiO_2$ thermal oxide insulating layer 136 is formed to a thickness of 0.2 μm. The insulating layer 136 can be omitted. Furthermore, an emitter material, e.g., tungsten, molybdenum, or preferably diamond, having a low work function, or ferroelectrics, e.g., PZT or PLZT, is formed on the $SiO_2$ thermal oxide insulating layer 134 to fill the first recessed portion 131*a*. At this time, the pyramidal emitter 135 is formed to correspond to the first recessed portion 131*a*. The distal end portion 135*a* of the emitter 135 becomes sharp to have radius of curvature of about 1 μm to 100 μm at its distal end due to the growth of the thermal oxide insulating layer 134 into the recessed portion 131*a*. In this embodiment, a diamond layer is formed by CVD.

Figure 14C:
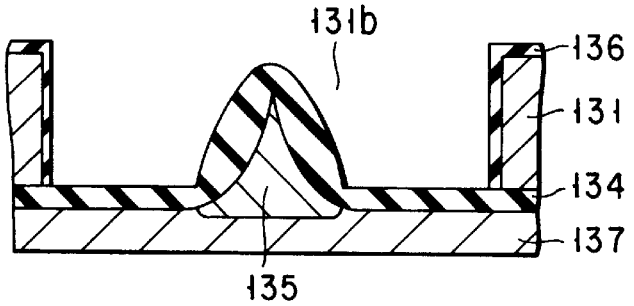

A layer made of a transparent conductive material, e.g., ITO, is deposited on the emitter 135 and the $SiO_2$ thermal oxide insulating layer 134 to form the cathode electrode 137 (FIG. 14C). Although the emitter 135 and the cathode electrode 137 are made of different materials in the structure shown in FIG. 14C, they may be made integrally of the same conductive material.

Figure 14D:
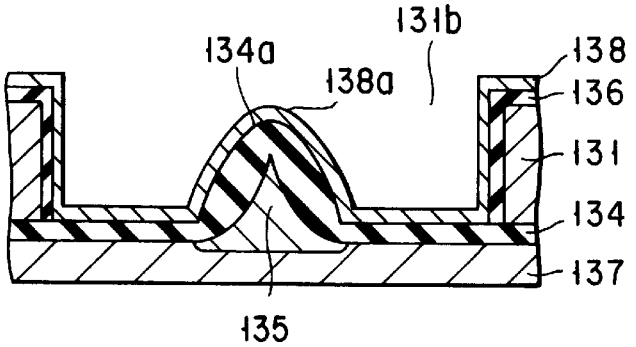

As a conductive layer 138 of the counter electrode, for example, a molybdenum layer is formed on the insulating layer 136 including the pyramidal distal-end projecting portion 134*a* of the $SiO_2$ thermal oxide insulating layer 134 and the inner surface of the second recessed portion 131*b* (FIG. 14D). In this embodiment, the molybdenum layer is formed by sputtering to have a thickness of 0.9 μm.

A resist is applied to the conductive layer 138 to form a resist layer. The resist layer is selectively dry-etched with an oxygen plasma to expose the distal end portion of a pyramidal projecting portion 138*a* of the conductive layer 138 by about 0.7 μm. Thereafter, the conductive layer 138 on the pyramidal distal-end projecting portion 134*a* is removed by reactive ion etching (RIE). The $SiO_2$ thermal oxide insulating layer 134 is selectively removed with an $NH_4F$—HF solution mixture by using the remaining resist layer or another resist layer as a mask. As a result, the counter electrode 139 having an opening portion 139*a* is formed, and the distal end portion 135*a* of the pyramidal emitter, i.e., the cold cathode 135, is exposed.

The glass substrate 142 is adhered to the cathode electrode 137 side as the support substrate. If the cathode electrode 137 itself serves as a support body for forming the air-tight discharge cells 143, the glass substrate 142 can be omitted.

Figure 14E:
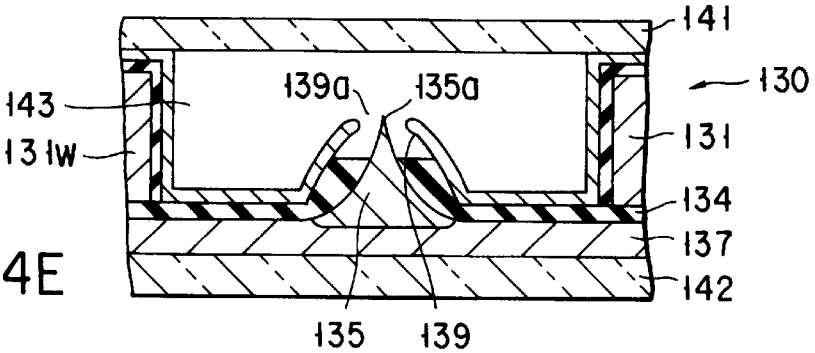

The glass substrate 141 is adhered to the glass substrate 142 through the single-crystal substrate 131 to form the plurality of discharge cells 143 in which a discharge gas, e.g., He—Ne, He—Xe, Ne—Xe, or the like is sealed (FIG. 14E). The distance among the plurality of discharge cells 143, i.e., the width of each partition wall 131*w* formed of the single-crystal substrate 131 becomes about 0.1 μm to 100 μm in accordance with the distance among the resist layers 113 (see FIGS. 13A and 13B).

Finally, components such as the glass substrate 101 and the backlight 107 shown in FIG. 11 are disposed on and under the discharge cell array block 130 in accordance with various known methods.

In this manner, with the manufacturing method shown in FIGS. 14A to 14E, the pyramidal emitter 135 having the pointed distal end portion 135*a* and a uniform height can be stably obtained, in the same manner as in the manufacturing method shown in FIGS. 13A to 13F. Furthermore, since the emitter distal end portion 135*a* and the counter electrode 139 are formed to sandwich the $SiO_2$ thermal oxide insulating layer 134, the distance between the counter electrode and the emitter can be controlled highly precisely in accordance with the thickness of the insulating layer 134. Even if the insulating layer 134 is formed by CVD or anodization, the same effect can be obtained.

Figure 12:
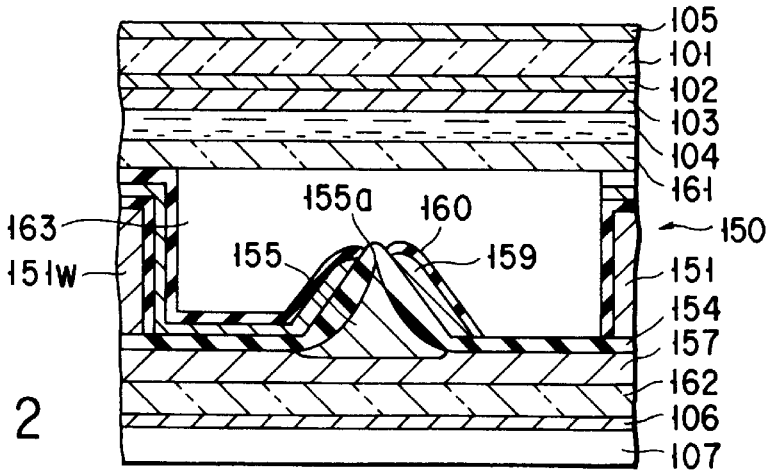
FIG. 12 is a sectional view illustrating a plasma liquid crystal display according to still another embodiment of the present invention.

FIG. 12 is a sectional view illustrating a plasma liquid crystal display according to still another embodiment of the present invention. In FIG. 12, sections that form an angle of 90° are joined at the center.

The plasma liquid crystal display according to this embodiment has a discharge cell array block 150 divided into a plurality of discharge cells 163 arranged in a matrix. As shown in FIG. 12, the discharge cells 163 are formed of an air-tight space sealed by opposing glass substrates 161 and 162, which are transparent and dielectric, and a spacer substrate 151 disposed between the glass substrates 161 and 162, and storing a discharge gas, e.g., He—Ne, He—Xe, Ne—Xe, or the like. The distance among the discharge cells 163, i.e., the width of each partition wall 151*w* formed of the substrate 151 is set to about 0.1 μm to 100 μm.

An emitter 155 connected to a cathode electrode 157 to emit electrons, and a counter electrode 159 formed on the emitter 155 through an insulating layer 154 are disposed in the discharge cell 163. The emitter 155 is not exposed from the insulating layer 154 but is covered completely. An $SiO_2$ insulating layer 160 is disposed to cover the counter electrode 159. Electrons emitted from the emitter 155 pass through the insulating layer 154 in accordance with the tunnel phenomenon. Although only one emitter 155 is shown in FIG. 12, a plurality of emitters may be disposed in each discharge cell 163. When a backlight is not used or when a transparent electrode is used, the emitter 155 and the cathode electrode 157 can be formed of the same material.

Components such as an opposing glass substrate 101, a backlight 107, and the like are disposed on and under the discharge cell array block 150, in the same manner as in the plasma liquid crystal display shown in FIG. 10.

A distal end portion 155*a* of the emitter 155 is sharp to have a radius of curvature of about 1 μm to 100 μm at its distal end. As described above, as the emitter material, a normal electrode material, e.g., molybdenum, tungsten, Si, or the like can be used. As the emitter material, a material having a low work function (a negative electron affinity), e.g., diamond, or ferroelectrics, e.g., PZT or PLZT, can be used.

With the plasma liquid crystal display shown in FIG. 12, the same effect as that obtained with the plasma liquid crystal display shown in FIG. 11 can be obtained. Furthermore, since the emitter 155 and the counter electrode 159 are respectively covered with the insulating layers 154 and 160, they are protected from the plasma in the cell. As a result, a plasma display having a long service life can be provided. In this case, the plasma may be maintained by applying an AC voltage.

A method of manufacturing the discharge cell array block 150 of the plasma liquid crystal display shown in FIG.12 is similar to the manufacturing method shown in FIGS. 14A to 14E. The difference is that, in the step shown in FIG. 14D, after the opening portion for the counter electrode is formed, the $SiO_2$ insulating layer 160 is further formed, and in the subsequent step, when etching the insulating layer 160 and a portion above the emitter 155 of the counter electrode 159, the insulating layer 154 is left.

Figure 15:
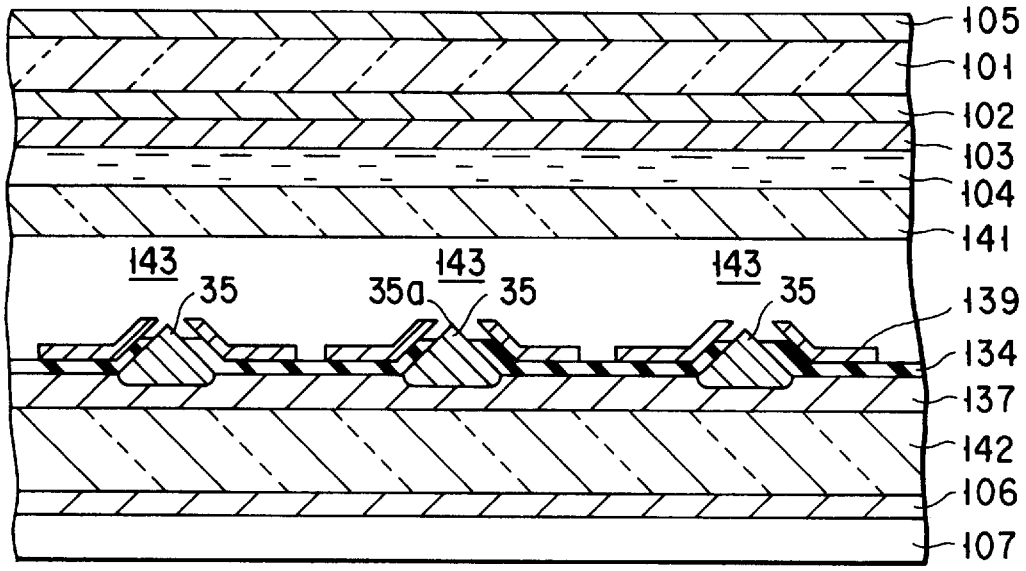
FIG. 15 is a sectional view illustrating a plasma liquid crystal display according to still another embodiment of the present invention.

FIG. 15 is a sectional view illustrating a plasma liquid crystal display according to still another embodiment of the present invention.

As shown in FIG. 15, the plasma liquid crystal display of this embodiment has a structure obtained by removing from the plasma liquid crystal display shown in FIG. 11 the partition walls 131*w* partitioning the emitters 135. In FIG. 15, portions corresponding to equivalent components in FIG. 11 are denoted by the same reference numerals, and a detailed description thereof will be omitted.

In the plasma liquid crystal display of the present invention, since the distance between the distal end portion of the emitter and the counter electrode can be decreased, a plasma can be locally generated between them, and in some cases, a plasma can be generated by Townsend discharge providing a high ultraviolet generation efficiency. Thus, even if the partition walls among the discharge cells are not present, the respective discharge cells can locally generate microplasmas without interfering with each other. More specifically, in the plasma liquid crystal displays shown in FIGS. 10 to 12, the partition walls 111*w*, 131*w*, and 151*w* can be omitted. FIG. 15 shows a plasma liquid crystal display of such an example, in which the structure shown in FIG. 11 is modified.

In the present invention, as described above, the term "discharge cell" means the discharge area arranged in an air-tight space to correspond to a plurality of pixels arranged in a matrix to display an image. Accordingly, a discharge area corresponding to the pixels is expressed by the unit "discharge cell" even when no partition walls are present in this manner.

The emitter of the plasma liquid crystal display shown in FIG. 15 can be manufactured in accordance with the manufacturing method described with reference to FIGS. 8A to 8H. In the step shown in FIG. 8B, however, an emitter material layer 74 is formed to a thickness to fill only a recessed portion 72.

Figure 16:
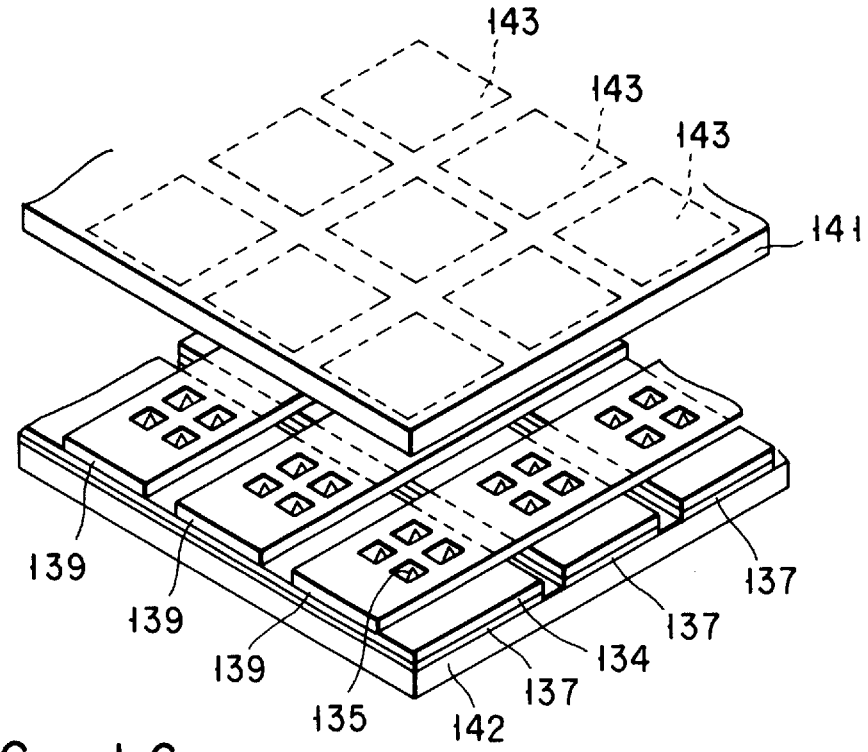
FIG. 16 is a developed perspective view showing a plasma liquid crystal display according to still another embodiment of the present invention.
Figure 17:
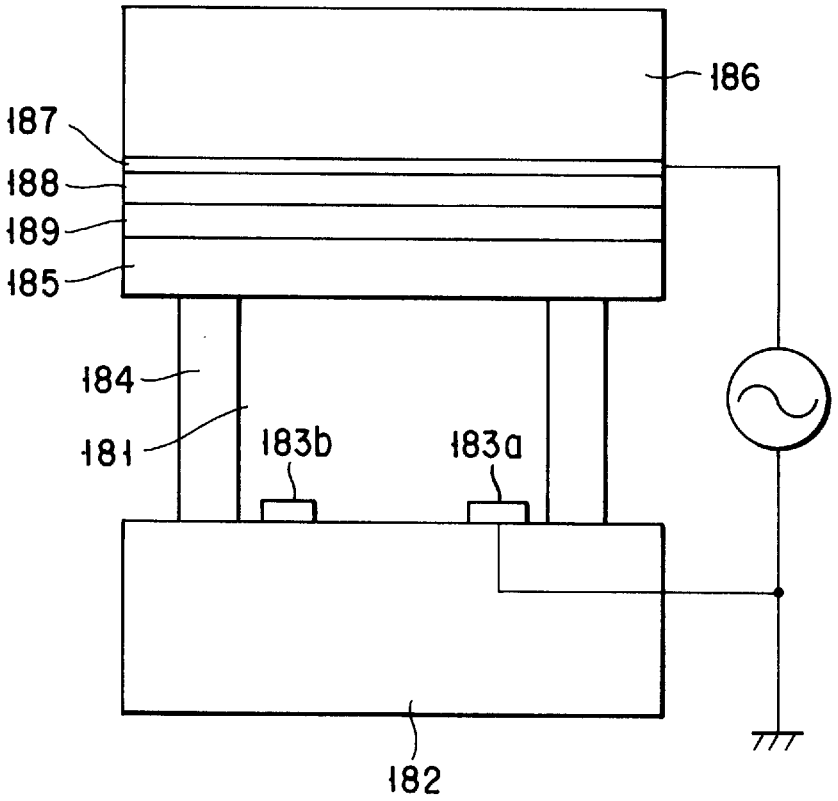
FIG. 17 PRIOR ART
FIG. 17 is a sectional view illustrating a conventional plasma liquid crystal display.

FIG. 16 is a developed perspective view showing the discharge cell array block of a plasma liquid crystal display according to still another embodiment of the present invention.

As shown in FIG. 16, the plasma liquid crystal display of this embodiment is obtained by applying the structure shown in FIG. 15. Each of a plurality of discharge cells 143 arranged in a matrix has four emitters 135. In FIG. 16, portions corresponding to equivalent components in FIG. 15 are denoted by the same reference numerals, and a detailed description thereof will be omitted.

As shown in FIG. 16, the lines of cathode electrodes 137 connected to the emitters 135 and the lines of counter electrodes 139 are perpendicular to each other, and the discharge cells 143 are arranged on their intersections. Accordingly, when the voltages across the electrodes of the discharge cells 143 are arbitrarily set through the lines of the cathode electrodes 137 and the lines of the counter electrodes 139, the ON and OFF states of the pixels can be selected. More specifically, the pixels can be selected in accordance with so-called matrix driving by line-sequentially selecting the lines of, e.g., the counter electrodes 139, to apply predetermined potentials to them, and by applying predetermined potentials as selection signals to the lines of the cathode electrodes 37 in synchronism with selection of the lines of the counter electrodes 139.

The present invention is not limited to this embodiment, but in any of the plasma liquid crystal displays shown in FIGS. 10 to 12 and FIG. 15, the lines of the cathode electrodes and the lines of the counter electrodes can be arranged perpendicularly. As a result, matrix driving can be performed in the same manner as in the embodiment shown in FIG. 16.

According to the embodiments described with reference to FIGS. 10 to 16, a plasma liquid crystal display in which the drive voltage is low, the drive circuit is simple, the problem of heat dissipation is solved, and pixels can be micropatterned, and a manufacturing method thereof can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A plasma display comprising:

an air-tight sealed space formed between a first substrate and a transparent second substrate;

a discharge gas stored in the sealed space;

a plurality of discharge cells arranged in the sealed space to correspond to a plurality of pixels arranged in a matrix to form an image;

a projecting discharge electrode supported by said first substrate and having a sharp distal end portion disposed in each of said discharge cells; and a counter electrode disposed in said discharge cell to oppose said distal end portion of said discharge electrode;

wherein said distal end portion of said discharge electrode has a radius of curvature in a range of 1 $\mu$m to 100 $\mu$m.

2. The display according to claim 1, wherein said counter electrode is supported by said second substrate.

3. The display according to claim 1, wherein said counter electrode is disposed on said discharge electrode through a first insulating layer and comprises part of a first conductive layer having an opening portion to correspond to said distal end portion of said discharge electrode.

4. The display according to claim 3, further comprising a second insulating layer that covers said first conductive layer from said discharge gas.

5. The display according to claim 1, wherein said discharge cells communicate with each other spatially.

6. The display according to claim 5, wherein partition walls are disposed among said discharge cells.

7. The display according to claim 1, wherein said distal end portion of said discharge electrode is made of a material selected from the group consisting of diamond and ferroelectrics.

8. The display according to claim 1, wherein said discharge cells are separated apart with a gap of 0.1 $\mu$m to 300 $\mu$m.

9. The display according to claim 1, further comprising a phosphor layer disposed in each of said discharge cells to emit light upon being excited by radiation obtained by converting said discharge gas into a plasma.

10. The display according to claim 9, wherein said phosphor layer is supported by said second substrate.

11. A plasma display comprising:

an air-tight sealed space formed between a first substrate and a transparent second substrate;

a discharge gas stored in the sealed space;

a plurality of discharge cells arranged in the sealed space to correspond to a plurality of pixels arranged in a matrix to form an image;

a projecting discharge electrode supported by said first substrate and having a sharp distal end portion disposed in each of said discharge cells;

a counter electrode disposed in said discharge cell to oppose said distal end portion of said discharge electrode;

a liquid crystal layer disposed on said second substrate and having a transmittance that changes in accordance with a change in applied voltage; and a transparent electrode opposing said discharge cells through said liquid crystal layer, wherein said discharge cells serve as switching elements that change, on the basis of conversion of said discharge gas into a plasma, a state of said liquid crystal layer so as to correspond to said respective pixels; and wherein said distal end portion of said discharge electrode has a radius of curvature in a range of 1 $\mu$m to 100 $\mu$m.

12. The display according to claim 11, wherein said counter electrode is supported by said second substrate.

13. The display according to claim 12, further comprising a second insulating layer that covers said first conductive layer from said discharge gas.

14. The display according to claim 11, wherein said counter electrode is disposed on said discharge electrode through a first insulating layer and comprises part of a first conductive layer having an opening portion to correspond to said distal end portion of said discharge electrode.

15. The display according to claim 11, wherein said discharge cells communicate with each other spatially.

16. The display according to claim 11, wherein partition walls are disposed among said discharge cells.

17. The display according to claim 11, wherein said distal end portion of said discharge electrode is made of a material selected from the group consisting of diamond and ferroelectrics.

18. The display according to claim 11, wherein said discharge cells are separated apart with a gap of 0.1 $\mu$m to 100 $\mu$m.

* * * * *

UNITED STATES PATENT AND TRADEMARK OFFICE

CERTIFICATE OF CORRECTION

PATENT NO. : 5,808,408

DATED : September 15, 1998

INVENTOR(S) : Masayuki NAKAMOTO

It is certified that error appears in the above-identified patent and that said Letters Patent is hereby corrected as shown below:

On the title page, item [30], Foreign Application Priority Date is incorrect. It should be:

--[30] Foreign Application Priority Data

Feb. 26, 1996 [JP] Japan ..... 8-038113
Mar. 11, 1996 [JP] Japan ..... 8-053243
Feb. 20, 1997 [JP] Japan ..... 9-036362--

Signed and Sealed this

Fifth Day of January, 1999

*Attest:*

*Attesting Officer*

*Acting Commissioner of Patents and Trademarks*